US006299570B1

(12) United States Patent
Lim

(10) Patent No.: US 6,299,570 B1
(45) Date of Patent: Oct. 9, 2001

(54) AB CHALLENGER EXERCISE APPARATUS

(76) Inventor: Edgar Lim, 2024 St. John Ave., Highland Park, IL (US) 60035

( * ) Notice: Subject to any disclaimer, the term of this patent is extended or adjusted under 35 U.S.C. 154(b) by 0 days.

(21) Appl. No.: 09/422,671

(22) Filed: Oct. 21, 1999

(51) Int. Cl.[7] ..... A63B 23/02

(52) U.S. Cl. ..... 482/148; 473/497; 473/447; 434/248

(58) Field of Search ..... 482/148, 33–34, 482/36–38, 41–42; 273/1.5 A, 1.5 R, 368, 406, 396–402, 371, 397, 394, 26 R, 36 A, 390–1, 85 C, 105.2, 85 R, 85 E; D21/48; 108/131, 133; 272/101–103; 473/497, 447; 434/248

(56) References Cited

U.S. PATENT DOCUMENTS

| | | | | |
|---|---|---|---|---|
| 3,365,196 | * | 1/1968 | Miller . | |
| 3,958,806 | | 5/1976 | Brown . | |
| 4,974,832 | | 12/1990 | Dalebout . | |
| 5,035,423 | | 7/1991 | Arciniega . | |
| 5,074,552 | * | 12/1991 | Gomez et al. | 273/1.5 A |
| 5,171,009 | * | 12/1992 | Filewich et al. | 273/1.5 A |
| 5,246,225 | * | 9/1993 | Matherne et al. | 273/1.5 |
| 5,246,255 | * | 9/1993 | Matherne et al. | 273/1.5 A |
| 5,277,431 | | 1/1994 | O'Grady . | |
| 5,443,259 | | 8/1995 | Segan et al. . | |

* cited by examiner

*Primary Examiner*—Jerome W. Donnelly
*Assistant Examiner*—Lori Amerson
(74) *Attorney, Agent, or Firm*—Adrienne B. Naumann, Esq.

(57) ABSTRACT

The exercise apparatus the AB Challenger Apparatus, is an exercise device which is comprised of light cylindrical straight and curved components, which are easily assembled by the use of cylindrical joints. The apparatus described herein is particularly recommended for strengthening all abdominal muscles, serratus anterior, chest muscles, anterior deltoids, flexor groups of the hand and leg muscles.

11 Claims, 37 Drawing Sheets

[8]

AB CHALLENGER EXERCISE APPARATUS

This application is related to U.S. disclosure documents 452,838.

BACKGROUND OF INVENTION

My invention relates to mechanical exercise devices which strengthen abdominal muscles as well as rib muscles. My device also effectively develops fine movement muscles of hands and feet, with basketball exercises of appropriate movement dimension. Specific muscles affected by my stationary apparatus include: rectus abdominal muscles, external and internal obliques and serratus anteriors, anterior deltoids and flexor hand groups.

In the past exercise devices have been physically more complex and do not lend themselves easily to use in a small space, such as the user's apartment. U.S. Pat. No. 4,974,832(Dalebout) discloses a machine for rowing-type exercises for a slant board. U.S. Pat. No. 3,958,806 discloses a barrel ball game with a plurality of spaced baskets. A series of manually actuated ball assemblies are arranged to place the ball towards one of the baskets.

U.S. Pat. No. 5,074,552(Gomez et al.) discloses a basketball-type apparatus with a hoop mounted to a backboard. The backboard is offset from a rotary drive system to carry the backboard and hoop through a horizontally disposed arc.

U.S. Pat. No. 5,035,423 (Arciniega) discloses a basketball training facility comprised of an enclosed area. There are also a ball return device, a selectively rotating basketball goal, and a track mounted motor driven carriage. U.S. Pat. No. 5,246,225 (Matherne et al.) disclosed a foldable arcade game apparatus and method by which games may be played using a ball and a support portion in an upright position.

U.S. Pat. No. 5,443,259 (Segal et al.) discloses a game apparatus with combines pinball, target bowling and basketball games in a single combined assembly. It has a common scorekeeping and control system.

The above described variety of machines do not maintain strength of specific muscle groups, using a mechanical device approach.

SUMMARY OF THE INVENTION

My invention comprises a mechanical apparatus for exercising the rectus abdominal muscles, external and internal obliques, anterior deltoids and serratus anterior (rib muscles) with basketballs. This device also effectively exercises fine movement muscles such as hands and feet with balls of appropriate size.

In the preferred embodiment my exercise apparatus can strengthen all the abdominal muscles, by using the appropriate exercises. The muscles which are most benefitted are the rectus abdominis, and external and internal obliques. However, my preferred embodiment is also effective on neck and upper body muscle groups. These muscles include those of the upper body trunk such as: sternocleidomastoid, scalenes, upper trapezius pectoralis (major and minor), anterior deltoids, serratus anterior, triceps and flexor hand groups.

The preferred embodiment comprises three spaced basketball hoops with backboards. All three basketball hoops are equal in size and shape in the preferred embodiment, although different sizes and shapes are also within the scope of my invention.

This application is related to P.T.O. Disclosure Document No. 452838, Filed Mar. 11, 1999 by Edgar Lim, Re AB Challenger Exercise Apparatus.

The central basketball hoop adjustable linearly in an anterior/posterior direction. Each side basket is approximately sixty degrees from the center basket. However, these side baskets are adjustable to more or less than a sixty degree angle in all my embodiments.

Accordingly, one goal of my invention is to provide a practical means by which an individual can exercise numerous groups of muscles in a small area such as an apartment;

Another goal of my invention is to provide a cost-effective apparatus by which a person can use numerous exercise approaches to strengthen many groups of muscles simultaneously.

These goals and other advantages and the scope of my invention will become more apparent in the drawings and the detailed description of the invention, infra.

BRIEF DESCRIPTION OF THE DRAWINGS

FIG. 1(*b*): Partial front view of invention.

FIG. 10(*b*): Closeup view of swivel attachment with screw members and teeth tightened.

FIG. 10(*c*): Closeup view of swivel attachment when loosened.

FIG. 14(*b*): Isolated front view of vertical basketball hoop height adjustor with adjacent upwardly protruding basket stand support bar.

FIG. 14(*c*): Schematic representations of each vertical basketball hoop height adjustor bar with two linear sets of pinholes.

FIG. 14(*d*): Schematic representation of metal pines aligned is with corresponding pinholes within each vertical basketball hoop adjustor bar.

FIG. 15(*b*): Side view of basketball rim with ball, spring attachment and backboard.

FIG. 15(*c*): Top plan view of spring attachment within basketball hoop base.

FIG. 16(*b*): Front cutaway view of how pin penetrates hollow cylindrical support bar and anterior-posterior adjustor bar.

FIG. 17(*b*): Isolated front view of clasp connecting basketball hoop to front surface of corresponding backboard.

FIG. 18(*b*): Closeup view of pin alignment through two pinholes in vertical footstand support bar and vertical footstand height adjustor.

FIG. 19(*b*): Isolated top plan view of joints for foot stand attachment, arm rest attachment and arm pad.

FIG. 19(*c*): Isolated upper plan view of posterior base with upwardly protruding hollow cylindrical joints.

FIG. 19(*d*): Isolated upper plan view of horizontal base bar with appending T-joints at each end of bar.

FIG. 20(*b*): Isolated view of lower support bar beneath upper anterior-poster support bar with common stem.

FIG. 24(*b*): Side detailed view of joint and screw member structure.

FIG. 26(*b*): Isolated side view of how arm grip pivots on two angled joints.

FIG. 28(*b*): Isolated closeup front view of three prongs of basketball hoop attachment, horizontal support bar, and lower anterior-posterior support bar.

DETAILED DESCRIPTION OF THE PREFERRED EMBODIMENT OF THE INVENTION

My invention 1 (AB Challenger) is an amazing versatile exercise device which is assembled manually by color coded bands. Moreover, my invention is adjustable in two planes and fits easily within a small space, such as a room within an apartment.

My invention 1 has a base 2 with components comprising upwardly protruding vertical basketball hoop support bars 41*a*, 41*b* and upwardly protruding hollow cylindrical joints (generically 50). There are also elbow pads 16*a*, 16*b*, vertical foot stand support bars 79*a*, 79*b*. Vertical basketball hoop support stands 83*a*, 83*b* which resist excessive posterior forces on my invention. There are also pivoting arm grip supports 75*a*, 75*b*.

Figure 1:
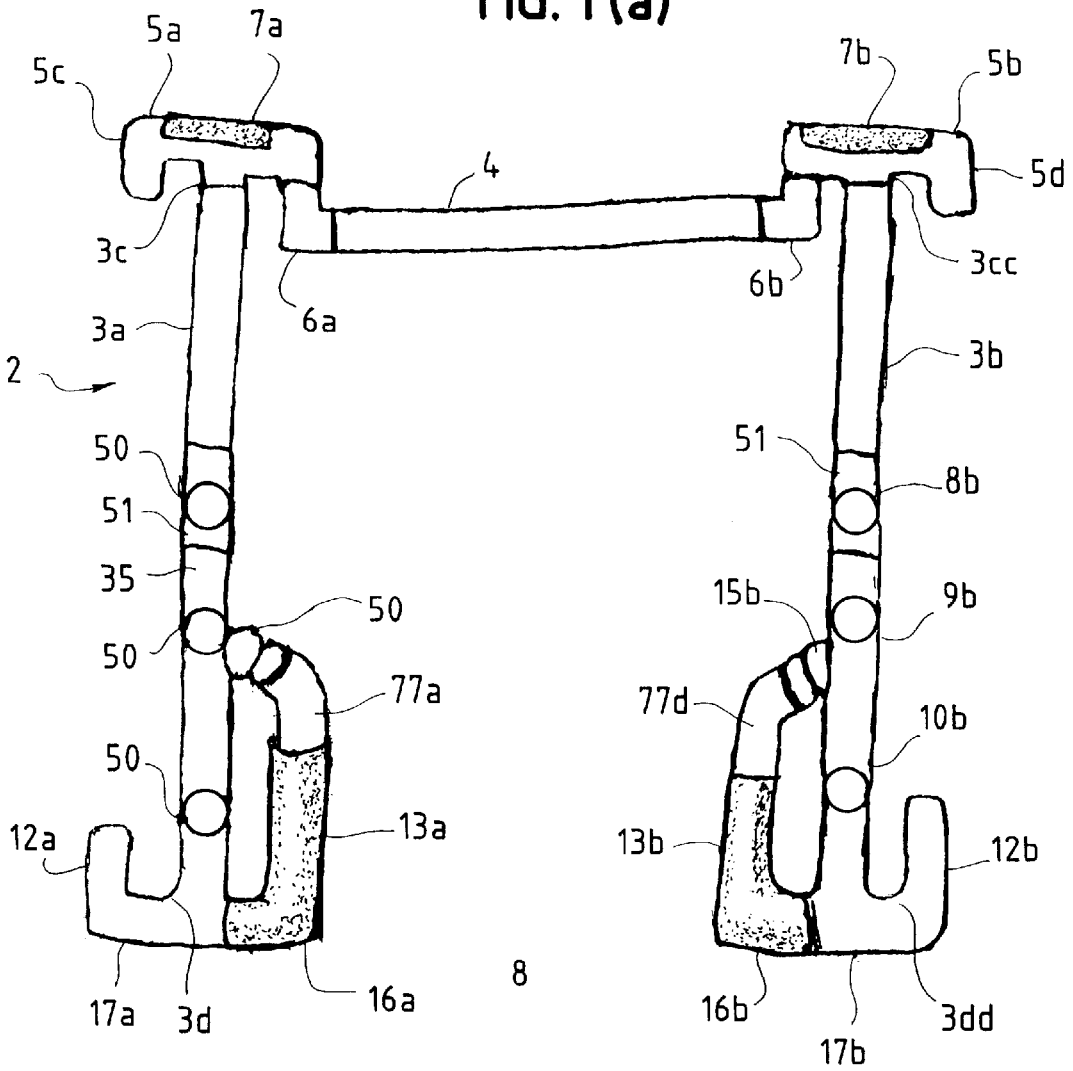
FIG. 1(*a*): Top plan view of base of AB challenger invention (hereinafter invention).
Figure 1:
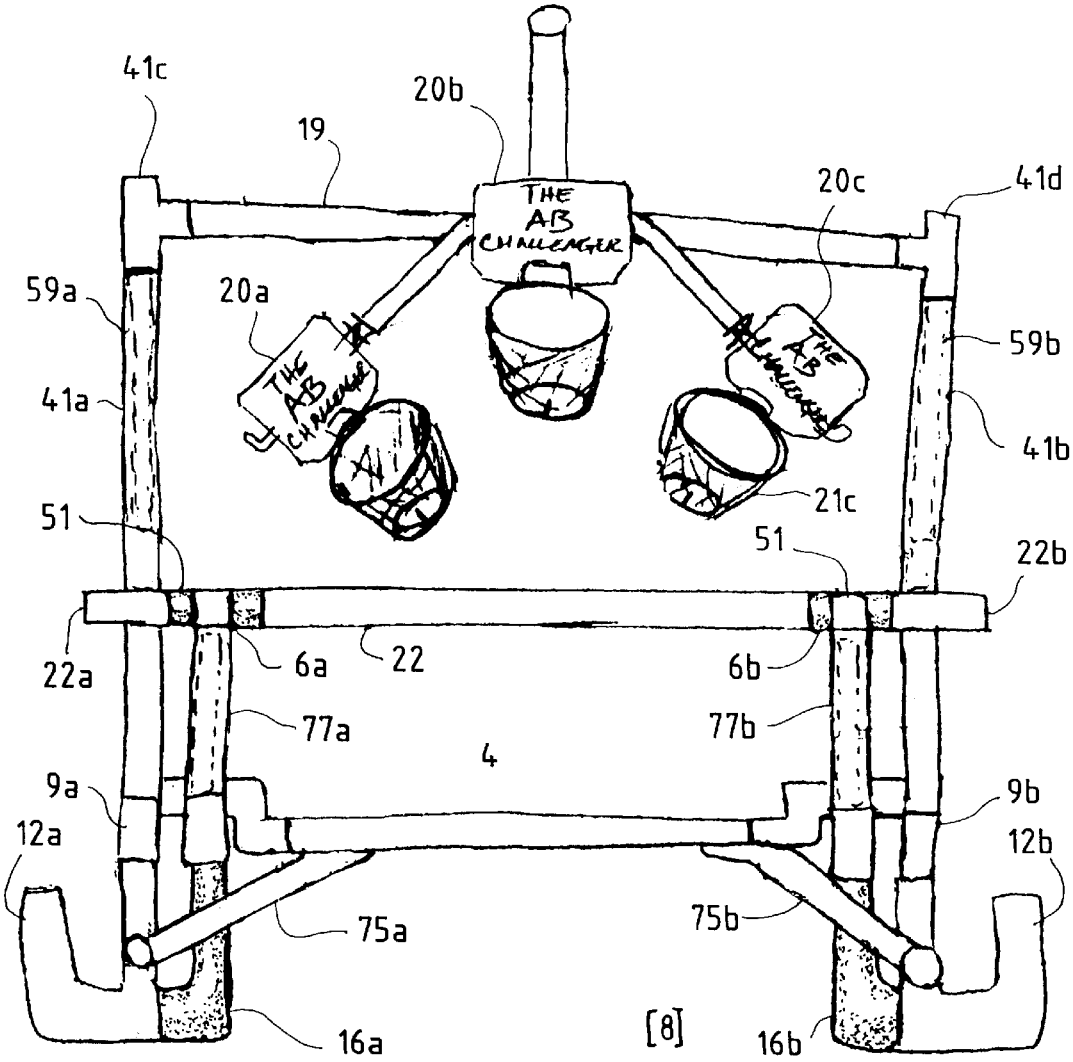

The second portion of my invention consists of rigid horizontal support bars which fit within specialized joints and attachments. There are also vertical and posterior-anterior height and/or length adjustors, as well as backboards 20*a*, 20*b*, 20*c*. There are basketball hoops 21*a*, 21*b*, 21*c* and attachments of basketball hoops 21*a*, 21*b*, 21*c* to horizontal basketball hoop support bar 19. FIG. 1(*b*) is a front view of the preferred embodiment of my AB Challenger 1.

In the preferred embodiment of my invention 1 as seen in FIG. 1(*a*), there is a base 2. Elbow pads 16*a*, 16*b* are located on upper surface 3s of lateral base support bars 13*a*, 13*b*. Rubber grips for wall protection 7*a*, 7*b* are located at posterior ends 5*a*, 5*b* of each of two connecting base segment members 3*c*, 3*cc*. As seen in FIG. 1(*b*), elbow pads 16*a*, 16*b* are located anteriorly to upwardly protruding vertical basketball hoop support bars 41*a*, 41*b*.

Hand grips 75*a*, 75*b* also appear anteriorly upon parallel anterior-posterior base bars 3*a*, 3*b*. Base bar 4 is integrally attached to parallel anterior-posterior base bars 3*a*, 3*b* with T-joint connectors 6*a*, 6*b* respectively.

Referring again to FIGS. 1(*a*) and 1(*b*), angled portions 12*a*, 12*b* of parallel anterior-posterior base bars 3*a*, 3*b* provides lateral support for entire base 2 and invention 1 generally. The significance of color banding 90 is to properly assemble appropriate parts of the invention , as discussed infra.

Again referring to FIG. 1, parallel anterior-posterior base bars 3*a*, 3*b* are integrally attached to horizontal base bar 4.

Each upper surface 3s of parallel anterior-posterior base bars 3*a*, 3*b* comprises rigid cylindrical upwardly protruding joints, generically referred to herein as upwardly protruding hollow cylindrical joints 50.

Each rigid cylindrical hollow upwardly protruding joint 50 reversibly holds upwardly protruding vertical components of my invention, by securing at least one end of that component. Each rigid cylindrical upwardly protruding joint 50 is in turn a component of a generic t-joint connector 51 as seen in FIG. 1(*a*). Each T-joint connector 51 is frictionally held in a predetermined location on base 2 or uponon other components, see infra.

Also integrally connected to ends 5*a*, 5*b* of each parallel anterior-posterior base bar 3*a*, 3*b* respectively, are T-joint connectors 5*c*, 5*d* respectively. Each T-joint connector 5*c*, 5*d* gives entire base 2 additional lateral support. Each of two second angled segments 12*a*, 12*b* further comprise elbow pads 16*a*, 16*b* as seen in FIG. 1(*a*). Each parallel anterior-posterior base bar 3*a*, 3*b* has a first end 3*c*, 3*cc* and a second end 3*d*, 3*dd* respectively. Vertical footstand support bars 77*a*, 77*b* are also seen in FIG. 1(*a*).

Figure 2:
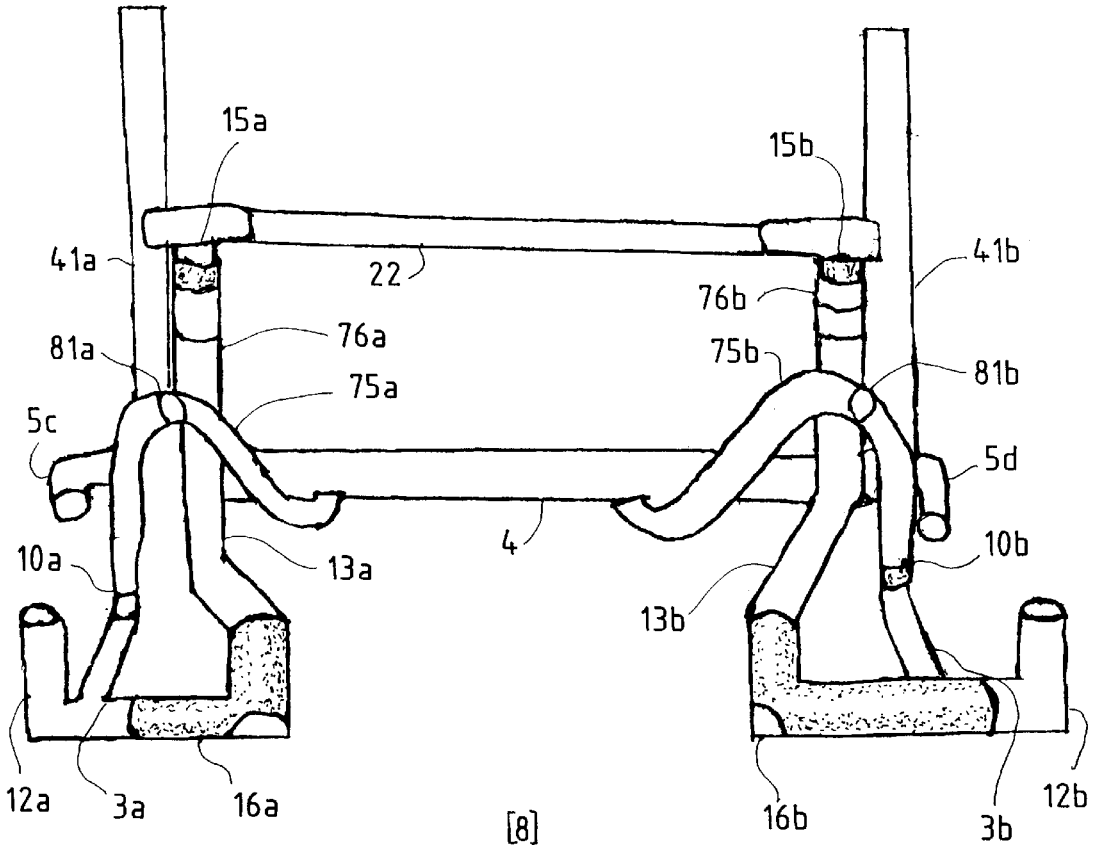
FIG. 2: Partial front view of invention with horizontal supports.
Figure 3:
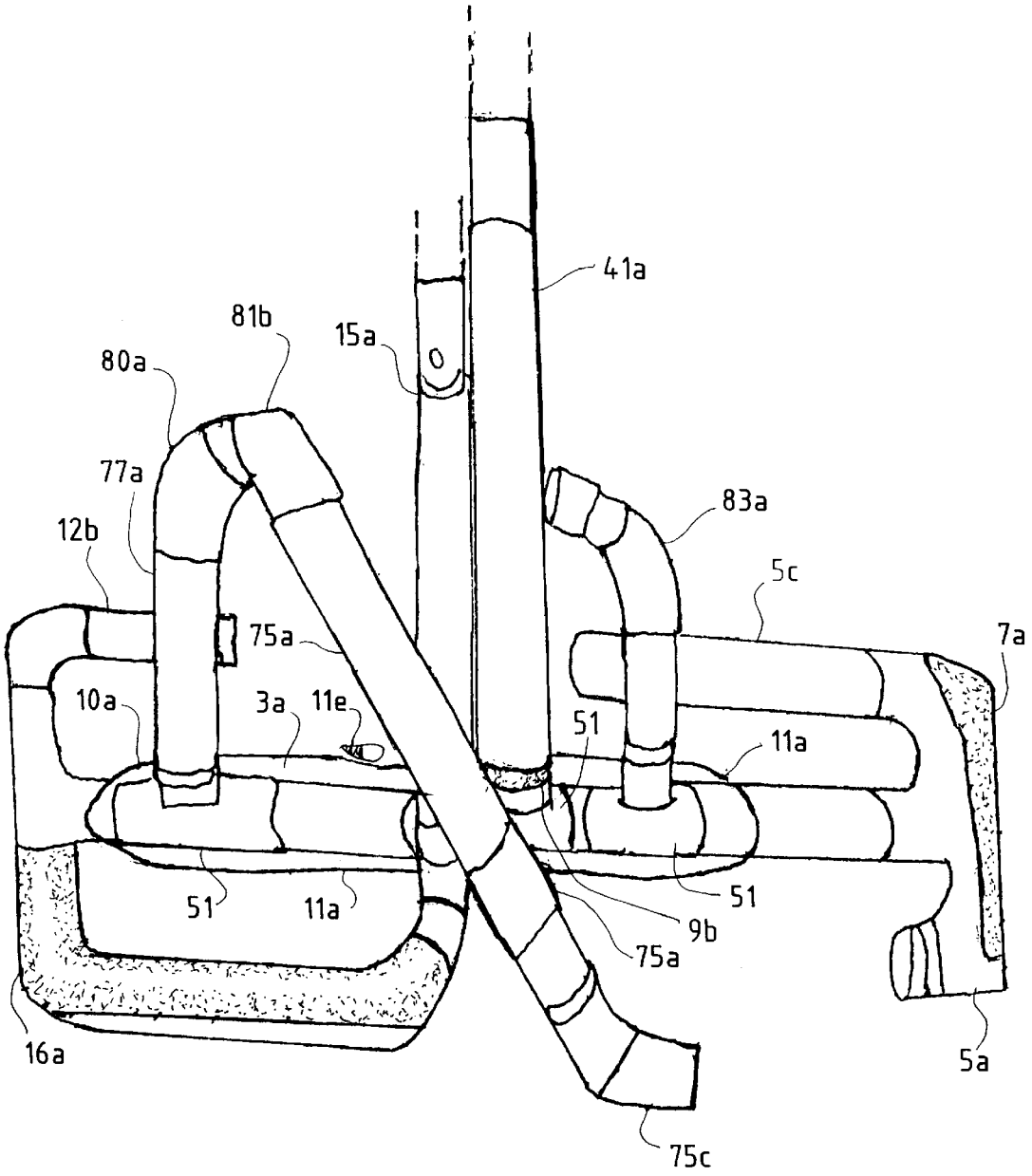
FIG. 3: Partial side view of invention, with base, hand grip, vertical foot support bar, upwardly protruding basketball hoop support bar, and lateral basket support bar.

As seen in FIG. 2, adjustable horizontal footstand bar 22 with two opposing ends 22*a*, 22*b* connect to vertical footstand support bars 77*a*, 77*b* respectively by T-joints connectors 51. Frictionally attached within each cylindrical upwardly protruding hollow joints 9*a*, 9*b* on each side of base 2 are upwardly protruding vertical rigid basketball hoop support bars 41*a*, 41*b* respectively, as seen in FIG. 3.

Each vertical upwardly protruding basketball hoop support bar 41*a*, 41*b*, comprises vertical basketball hoop height adjustors 59*a*, 59*b* indicated in FIG. 1(*b*). These adjustors change the vertical height of basketball hoops 21*a*, 21*b*, 21*c*, as explained infra.

Figure 8:
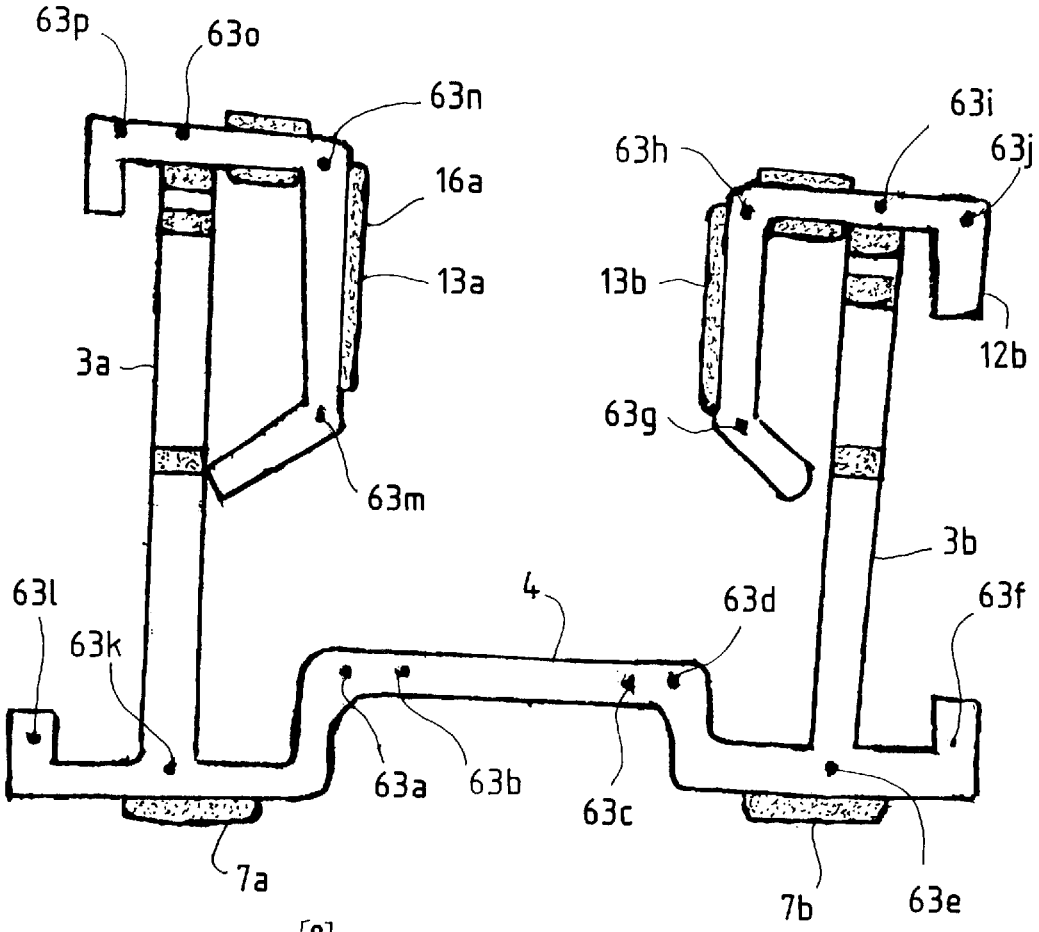
FIG. 8: Bottom plan view of base illustrating rubber grips.

Again referring to FIG. 1(*b*), each upwardly protruding basketball hoop vertical support bar 41*a*, 41*b* has a T-joint connector 42*c*, 42*d* respectively at each upper end thereof. Between these two upper T-joint connects 42*c*, 42*d* is horizontal basketball hoop support bar 19, which is parallel to supporting surface 8. FIG. 8 is a plan view of lower surface 2*c* of base 2. In this view one still sees elbow pads 16*a*, 16*b* and horizontal base bar 4. Hand grips 16*a*, 16*b* are comprised of foam rubber in the preferred embodiment. However, other appropriate materials such as generic velcro® or plastic are within the scope of my invention.

Horizontal footstand support bar 22 is approximately 3.125 feet in length and 3.25 feet from supporting surface 8. Horizontal footstand support bar 22 has its first end 22*a* attached at first T-joint connector 51 and its second end 22*b* attached at second T-joint connector 51.

All vertical components and base 2 are made of the same material in the preferred embodiment, which is off the shelf polyvinylchloride (PVC) piping. However, other materials, such as plastic, aluminum, stainless steel and wood are satisfactory and within the scope of my invention 1.

Figure 21:
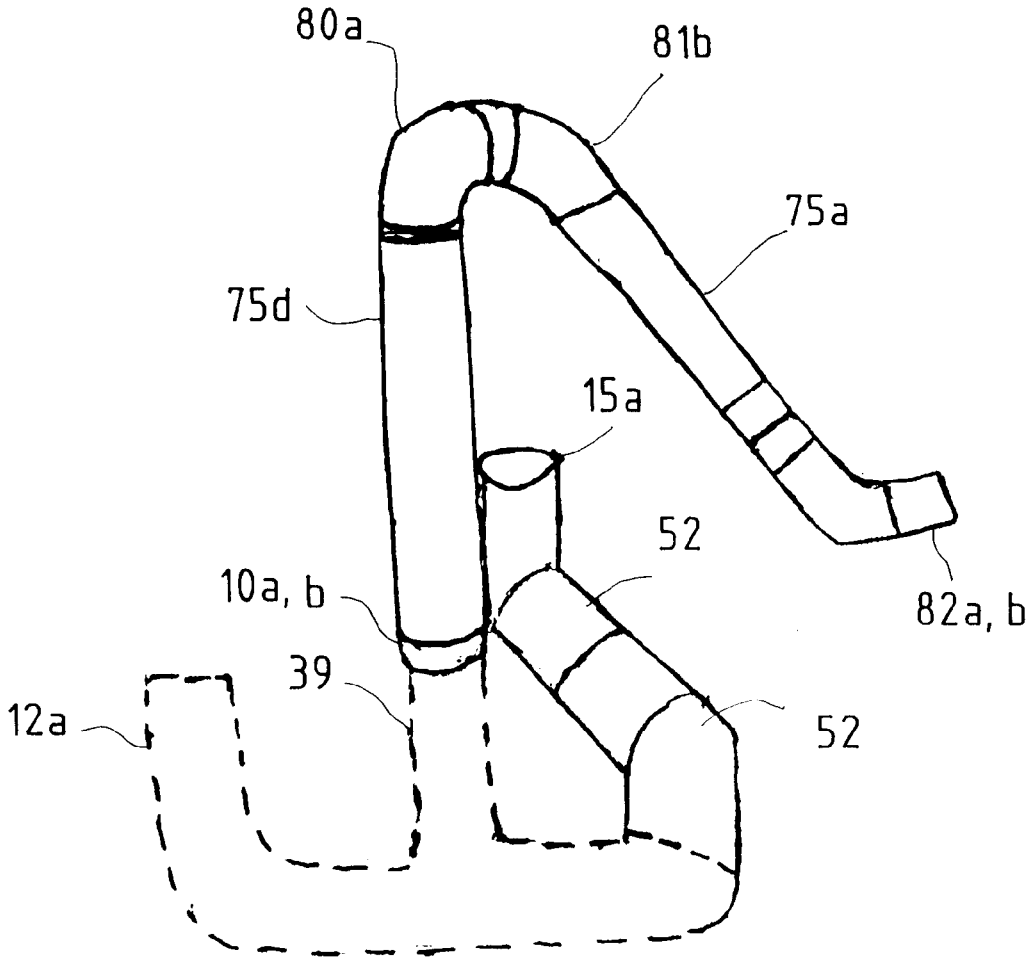
FIG. 21: Isolated closeup front view of armstand and armgrip with base components in phantom.
Figure 22:
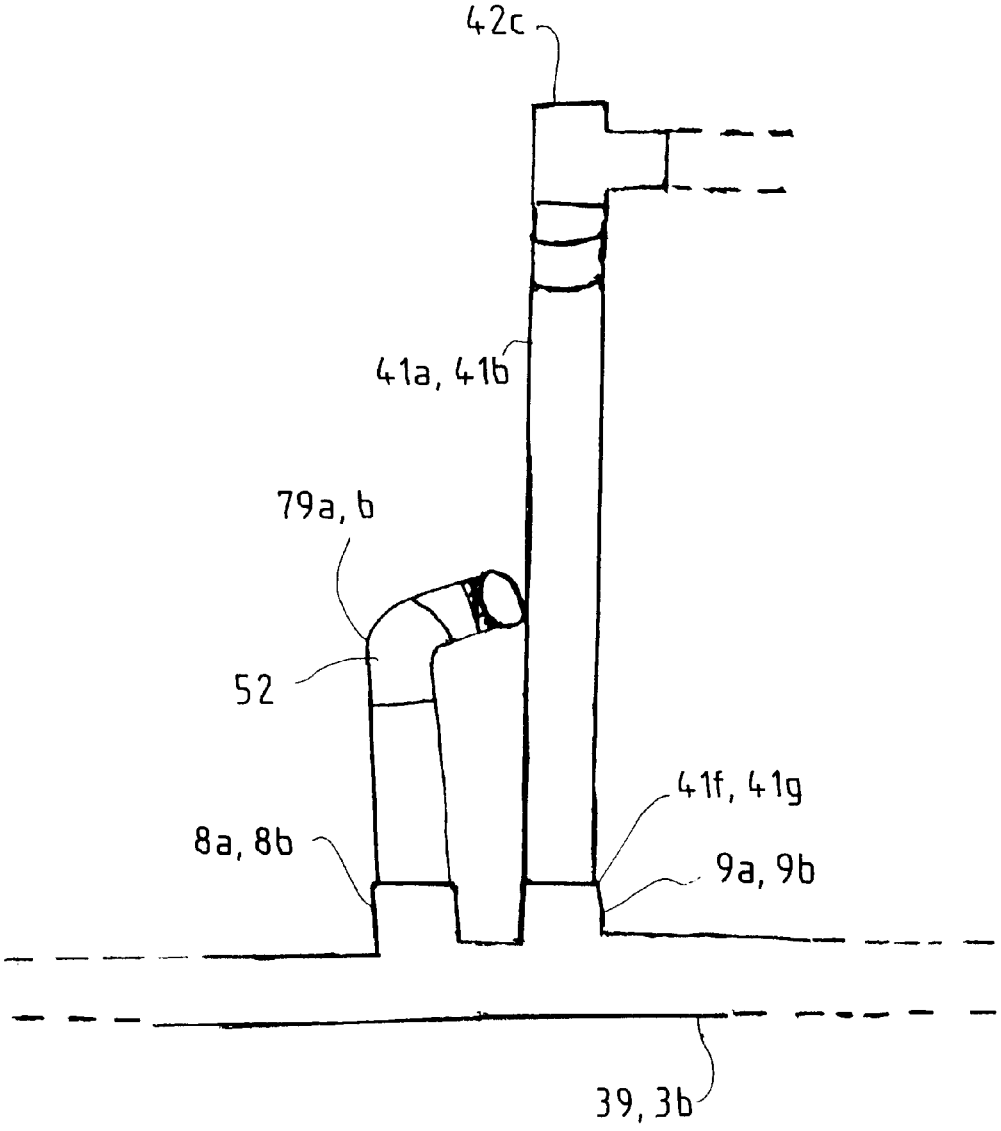
FIG. 22: Isolated view of vertical rigid upwardly protruding basketball hoop support bar and adjacent contacting upwardly protruding basket stand bar.

Elbow pads 16*a*, 16*b* each are approximately 5 and ½ inch in length, seven(7) inches in width, and approximately 11(eleven) inches in depth. FIG. 21 illustrates arm stand 75*d* and arm grip 75*a*. FIG. 22 illustrates the relationship between vertical basketball stand support bar 75*d* and basketball hoop stand support bar 77*a*.

FIG. 2 illustrates a second partial front view of my invention 1 in my preferred embodiment. There is a partial view of base 2, as well as curved hand grips 75*a*, 75*b* which reach towards horizontal base bar 4. Such vertical poles or bars are connected to base 2 by male-female joints 50.

These vertical supports, in turn support horizontal basket stand support bar 19, horizontal foot stand bar 22 and arm grips 75*a*, 75*b*.

Referring again to FIG. 1(*a*), integrally connected to and located interiorly and laterally from parallel anterior-posterior base bars 3*a*, 3*b* are doubled-angled extensions 13*a*, 13*b*. Double angled extensions 13*a*, 13*b* bend exteriorly at 17*a*, 17*b* to terminate in upwardly protruding rigid cylindrical joints 15*a*, 15*b* for horizontal footstand bar 22.

At most anterior ends 3*d*, 3*dd* angled segment 12*a*, 12*b* are contiguously connected to, but located exteriorly to anterior-posterior parallel base bars 3*a*, 3*b*. Angled segments 12*a*, 12*b* give additional lateral support to invention 1. Angled segments 12*a*, 12*b* give additional lateral support to invention 1.

Figure 9:
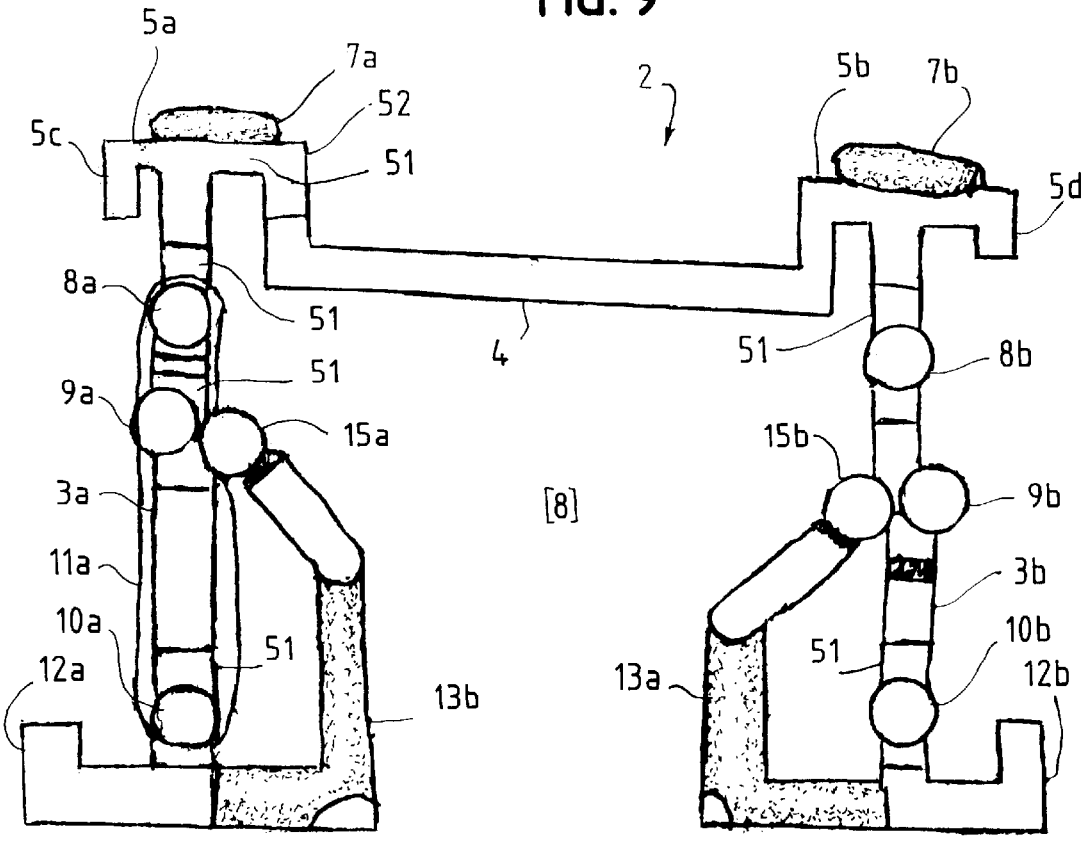
FIG. 9: Top plan view of base with upwardly protruding hollow cylindrical joints and accompanying support pads.

FIG. 9 is a plan view of upper surface 3s of base 2 of my preferred embodiment. There are hollow cylindrical rigid upwardly protruding joints 50, which in turn are physically integral components of prefabricated connectors for polyvinyl chloride piping. Hollow cylindrical rigid upwardly protruding joints 50 can be prefabricated as generic T-joints 51. Connectors 51 and other connectors and fittings for polyvinylchloride pipe construction are available from:

Hollow cylindrical rigid upwardly protruding joints 50 can also be made of aluminum, other light metals, plastics with sufficient rigidity and strength, or other appropriate materials. Hollow rigid cylindrical upwardly protruding joints 50 are approximately four inches to six inches in height and approximately 1 and ½ inch in diameter in the preferred embodiment.

However, my invention also encompasses other heights and diameters of hollow cylindrical rigid upwardly protruding joints 50. The requirement is that such joints 50 reversibly, but firmly receive a particular component in a male-female relationship. In the most preferred embodiment upwardly protruding hollow cylindrical joints 50 are components of these conventional prefabricated T-joint connectors 51. Please see FIG. 9.

PVC piping is generally hollow and approximately one and one quarter (1 and ¼") inches in inner diameter in the preferred embodiment. However, such piping need not be hollow if it is not cumbersome or cost-prohibitive. Polyvinychloride (PVC)piping for the preferred embodiment can be purchased at:

Each PVC pipe comprising anterior-posterior base parallel bars 3*a*, 3*b* in my most preferred embodiment is approximately 18(eighteen) inches in length, and with a hollow inner diameter of 2 and ½ inches. However, diameters of different pipes in the structure of my invention may range from approximately 1 and ½ inches to approximately 1(one) inch.

Other prefabricated connectors include angled joints 52 for hand grips 81*a*, 81*b*, 80*a*, 80*b*, and four-member connectors 53 for other horizontal connections, as well as straight extension connectors 54. Each prefabricated joint 52 has an angle of approximately 45 degrees at approximately the center of the connector.

The length of upwardly protruding vertical basketball hoop support bars 41*a*, 41*b* are approximately 11.25 inches. However, other lengths are acceptable in the preferred embodiments and other embodiments of my invention if:

(1) the baskets remain at an appropriate predetermined height and (2) remain at the appropriate predetermined angle.

As seen in FIG. 1(*a*), horizontal base bar 22 is connected to parallel anterior-posterior base bars 3*a*, 3*b* by angled segments 5*a*, 5*b*. Angled segments 5*a*, 5*b* are both approximately 10 and ½ inches long.

Each T-joint connector 51 is approximately 7(seven)½ inches long. Angled segments 5*a*, 5*b* are also reversibly physically connected to horizontal base bar 4 by 45 degree angled joint connectors 6*a* and 6*b*. Each angled segment 5*a*, 5*b* has one rubber grip 7*a*, 7*b* respectively for wall protection, and is comprised of PVC piping.

As seen in FIG. 9, end connectors 3*d*, 3*dd* of parallel anterior-posterior base bars 3*a*, 3*b* comprise rigid hollow cylindrical upwardly protruding joints 8*a*, 8*b*. Joints 8*a*, 8*b* support angled basketball hoop support stands 79*a*, 79*b*(not seen)respectively. FIG. 9 also represents a top plan view of base 2 of my preferred embodiment without any vertical or upper horizontal members attached. The diameter of each rigid upwardly protruding rigid hollow cylindrical joint 50 is approximately 1 and ½ inches. Each upwardly protruding cylindrical rigid hollow joint 50 is approximately four to six inches in height.

Each anterior-posterior parallel base bar 3*a*, 3*b* also comprises at least one upwardly protruding cylindrical hollow joint 9*a*, 9*b*, and a third upwardly protruding cylindrical hollow joint 10*a*, 10*b*(in addition to upwardly protruding cylindrical hollow joints 8*a*, 8*b*).

As seen in FIG. 3 in side view, immediately anterior to upwardly protruding hollow cylindrical rigid joints 9*a*, 9*b* respectively are upwardly protruding cylindrical rigid hollow joints 10*a*, 10*b* for hand grips 75*a*, 75*b*. Upwardly protruding rigid cylindrical joints 10*a*, 10*b* connect each hand grip 75*a*, 75*b* with two consecutive 45 degree angle joints 52(specifically 80*a*, 80*b*, 81*a*, 81*b*). Each hand grip 75*a*, 75*b* also comprises an angled connector at the most distal end 75*c*, 75*d* as well.

Referring again to FIGS. 3 and 9, each of two bunge cords 11*a*, 11*b* respectively encircle each respective series of cylindrical hollow rigid hollow upwardly protruding joints: 8*a*, 9*a*, 10*a*, and 8*a*, 9*b*, 10*b* on parallel anterior-posterior base bars 3*a* and 3*b* respectively. Bunge cord 11*a*, 11*b* each is approximately ½ inch thick in the most preferred embodiment.

As seen in FIG. 3, each bunge cord 11*a*, 11*b* further comprises a hooks 11*e*, 11*f*, which connects ends 11*h*, 11*g*(not seen).

Each bunge cord 11*a*, 11*b* maintains posterior base 2*a* and anterior base 2*b* rigidly aligned. Bunge cords 11*a*, 11*b* further resist forces which tend to disrupt the invention's configuration. Heavy duty rubber bands are also satisfactory, but bunge cords with hooks is the most preferred choice.

Figure 4:
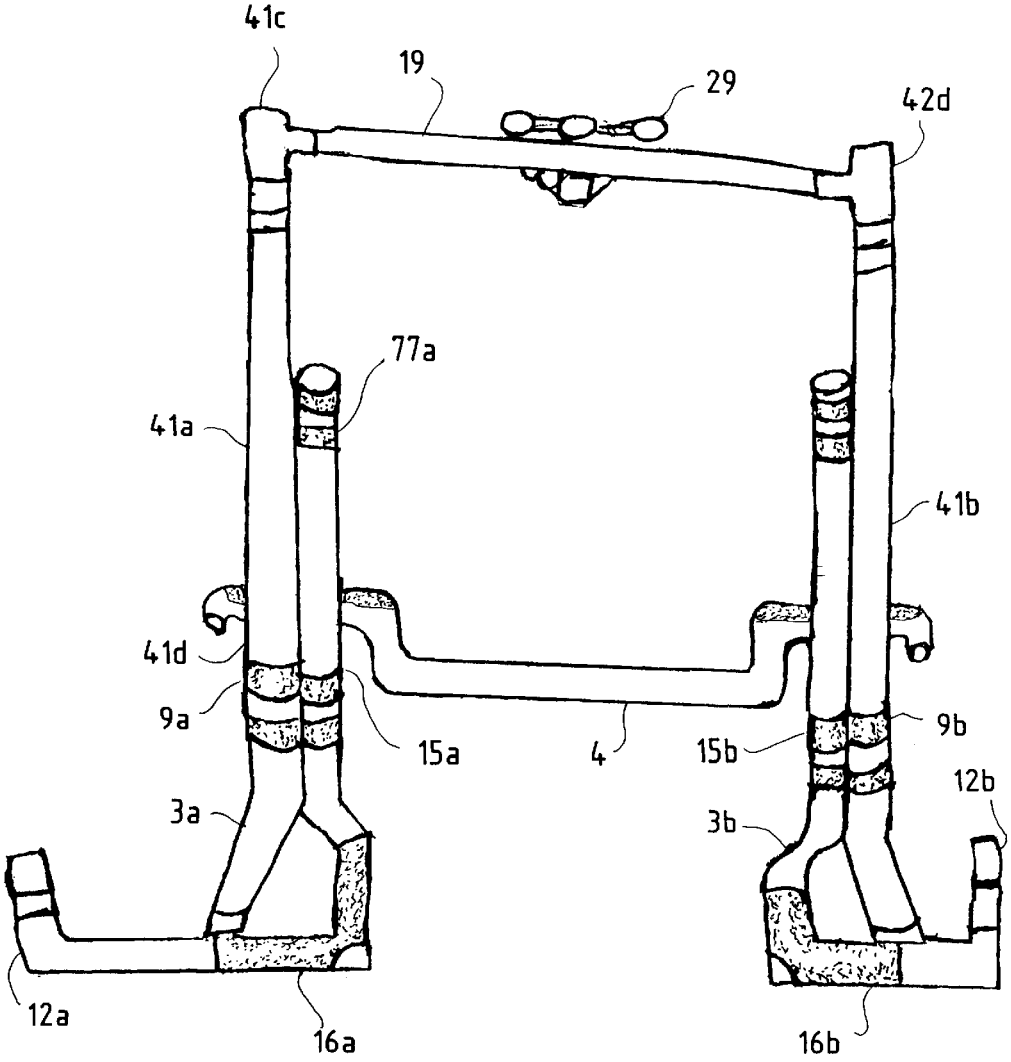
FIG. 4: Partial front view of horizontal base bar, basketball hoop vertical rigid upwardly protruding supports and horizontal foot stand support bar.

FIG. 4 illustrates the relationship among: horizontal base bar 4, horizontal cylindrical rigid upwardly protruding joints 15*a*, 15*b*, and upwardly protruding basketball rim vertical support bars 41*a*, 41*b*.

Upwardly protruding vertical support bars 41*a*, 41*b* have upper ends term terminating as T-joint connectors 42*c*, 42*d*. The length of lower horizontal foot stand support bar 22 is approximately 3 and ¼ feet in my preferred embodiment. However, other lengths are also acceptable and within the scope of my invention. Specifically the length of horizontal foot stand 22 can vary according to the dimensions and weight of other components and still remain within the scope of my invention.

Each upwardly protruding cylindrical rigid hollow joint 15*a*, 15*b* is immediately adjacent to, but not physically connected with, upwardly protruding vertical basketball hoop support bars 41*a*, 41*b*. Each vertical foot stand support bar 77*a*, 77*b* is approximately one foot tall.

Figure 6:
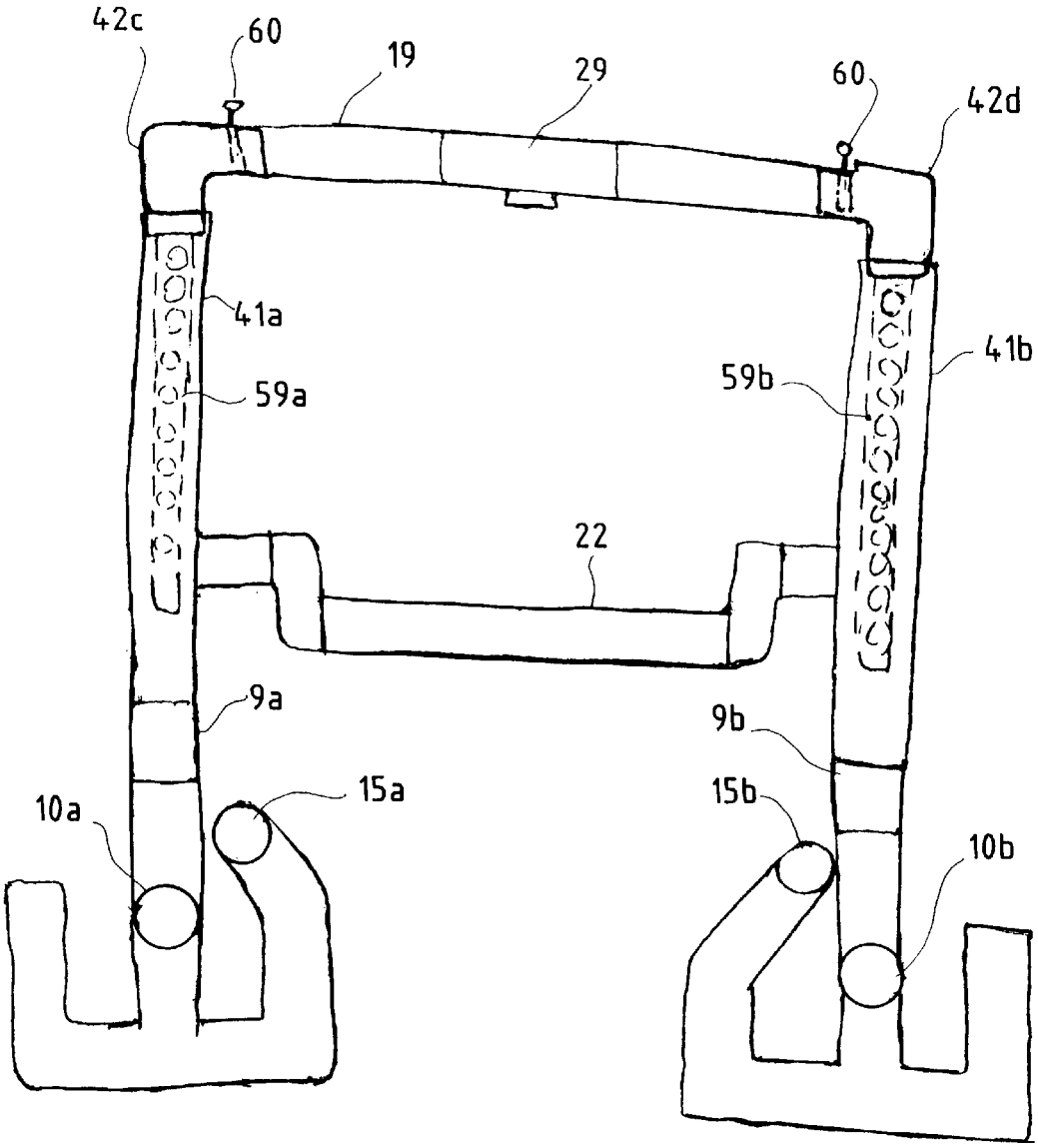
FIG. 6: Partial front view of base, basketball hoop upwardly protruding vertical support bars and vertical basketball hoop height adjustors.

FIG. 6 is an isolated front view of upwardly protruding rigid hollow cylindrical joints 15*a*, 15*b* which connect to horizontal foot stand support bar 22. Also seen are upwardly protruding vertical basketball hoop support bars 41*a*, 41*b*. Upwardly protruding vertical basketball hoop support bars 41*a*, 41*b* are each approximately 27 and ½ inches in height. Each upwardly protruding vertical basketball hoop support bar 41*a*, 41*b* is hollow and contains a vertical basketball hoop height adjuster 59*a*, 59*b* within.

Figure 19:
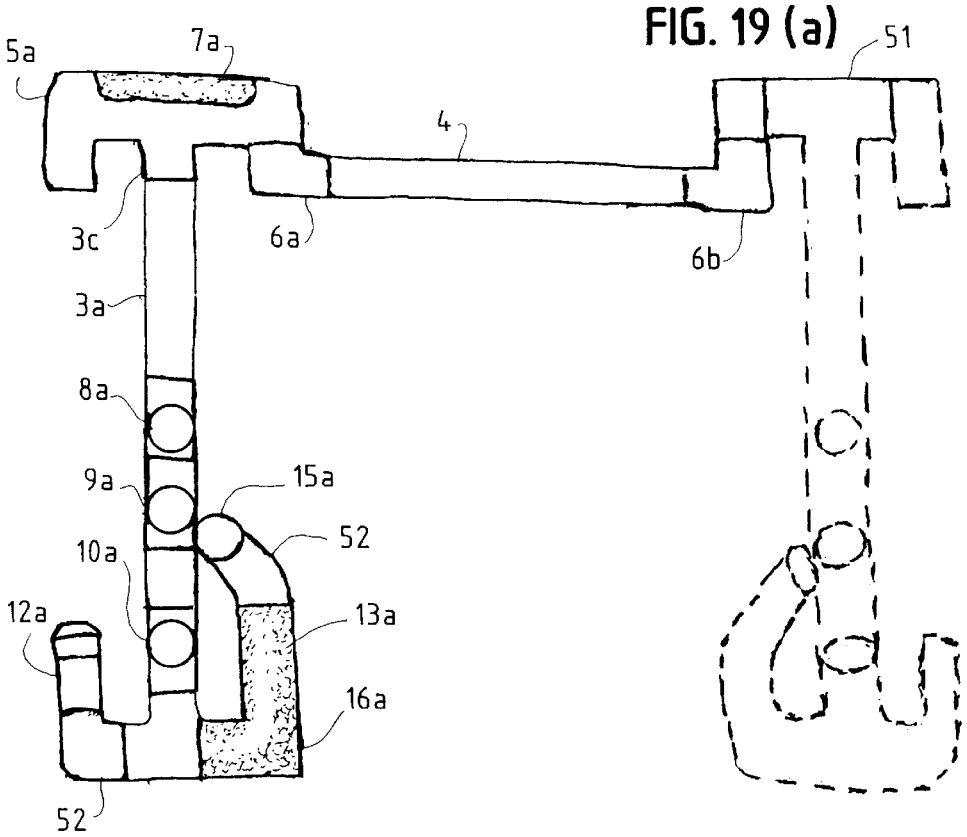
FIG. 19(*a*): Schematic top plan view of upwardly protruding cylindrical hollow joints on base upper surface showing symmetry by phantom drawing on opposite side.
Figure 19:
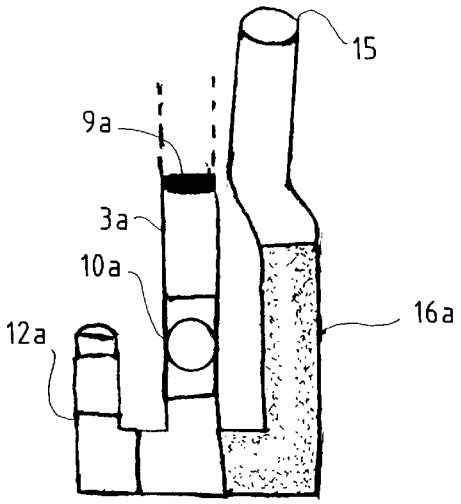
Figure 19:
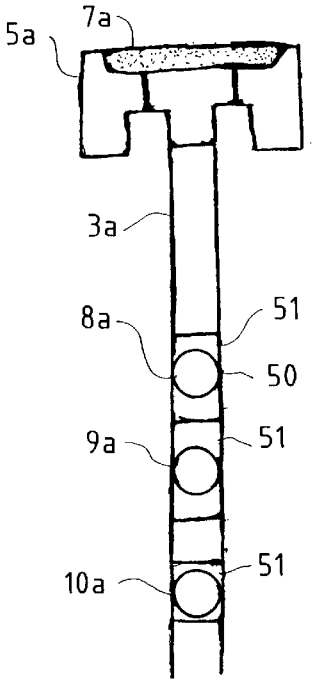
Figure 19:
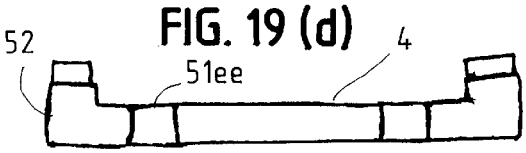

FIG. 19(*a*) illustrates the bilateral symmetry of the structure and design of base 2 as indicated in phantom. FIG. 19(*b*) also illustrates the relationship between upwardly protruding hollow cylindrical joint 10*a*, 10*b* and upwardly protruding hollow cylindrical joints 15*a*, 15*b*. Joints 15*a*, 15*b* reversibly receive ends 22*a*, 22*b* of horizontal footstand support bar 22 with T-joint connectors 51.

FIG. 19(*c*) illustrates a portion of parallel base bar 3*a* with two upwardly protruding hollow cylindrical joints 50 within separate T-joint connectors 51. FIG. 19(*d*) illustrates a portion of the connecting structure of horizontal base bar 4 with extension connectors 53 and T-joint connectors 51. Angled connectors 52 (at 45 degrees) are not seen in this view.

FIG. 8 illustrates base 2 in bottom plan view with location of circular rubber grips 63*a*, 63*b*, 63*c*, etc.(generically circular grips 63). Each circular rubber grip 63 is approximately 1.5 inches in diameter in the preferred embodiment.

Each grip 63 is permanently affixed to lower surface 3*t* of base 2 with a suitable adhesive. The adhesive in the most preferred embodiment is known as P4 PVC Cement, can be purchased from:

William H. Harvey Company

4334 South 67th Street

Omaha, Nebr. 68117-1019

Phone:402-331-1175; 1-800-228-9681

As of Jun. 1, 1999, P4 PVC cement(product name HV P-4 Regular PVC Cement, chemical name PVC solvent cements)manufactured by William H. Harvey Company has the following physical characteristics:

1. boiling point: 146 degrees Fahrenheit
2. vapor pressure(mm. Hg): 86
3. vapor density(air=1)2.5
4. solubility in water: moderate
5. appearance and odor: slightly viscous clear liquid with ketone odor
6. specific gravity(H20=1): 0.9000
7. Melting point: NI
8. Evaporation rate(butyl acetate=1)5.7 Components of P4 PVC cement comprise, but not exclusively, tetrahydrofuran, methyl ethyl ketone, and cyclohexanone.

However, other diameters and other shapes of such rubber grips are within the scope of my invention 1. More or few rubber circular grips 63 are also within the scope of my invention. Circular rubber grips 63 prevent damage to furniture, floors and walls in a small residential living room in which my invention 1 may be located.

Figure 11:
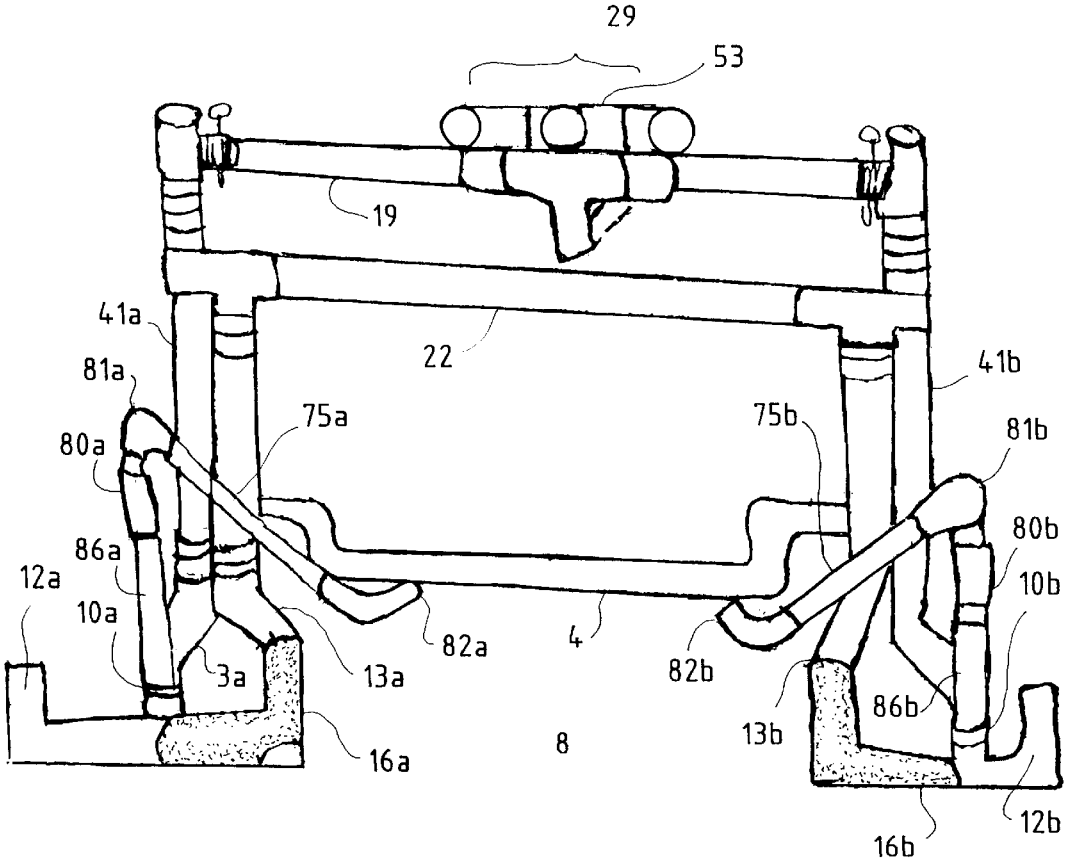
FIG. 11: Front view of horizontal foot stand support bar and base and horizontal basketball hoop support bar.

FIG. 11 illustrates base 2, horizontal base bar 4, horizontal basketball support bar 19, horizontal footstand bar 22, and arm grips 75*a*, 75*b*.

Figure 26:
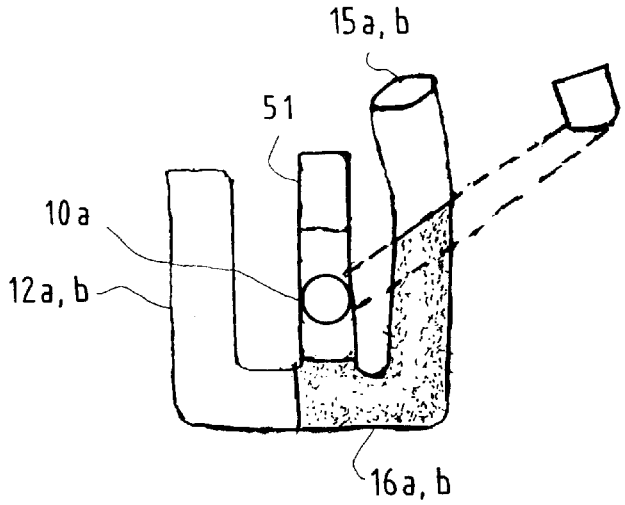
FIG. 26(*a*): Top plan view of upwardly protruding hollow cylindrical joint for hand grip(shown in phantom), elbow pad, and upwardly protruding hollow cylindrical rigid joint for foot stand.
Figure 26:
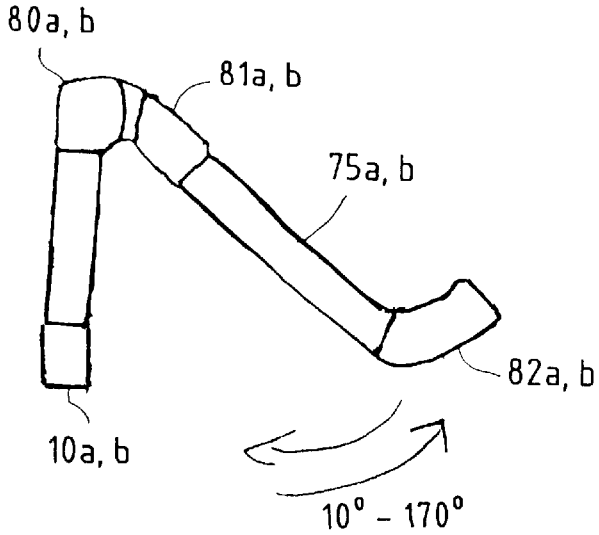

Arm grips 75*a*, 75*b* each have two upper angled joints 80*a*, 80*b* and 81*a*, 81*b* respectively, and lower ends 82*a*, 82*b* respectively. Lower ends 82*a*, 82*b* rest on supporting horizontal surface 8. Upper angled joints 81*a*, 81b attach to straight segments 86*a*, 86*b* which in turn are inserted into upwardly protruding rigid cylindrical hollow joints 10*a*, 10*b*. Please see also FIGS. 26(*a*),26(*b*). Arm grips 75*a*, 75*b* are oriented posteriorly towards horizontal base bar 4.

As seen in FIG. 3, projecting upward from each anteriorposterior parallel bar 3*a*, 3*b* are upwardly protruding vertical basketball hoop support bars 41*a*, 41*b* with height adjustors 58*a*, 58*b*(not seen)respectively. Height adjustors 59*a*, 59*b* change the distance from horizontal surface 8 for basketball hoops 21*a*, 21*b*, 21*c* in a vertical up/down direction. Horizontal footstand support bar 22 also has mechanisms for vertical adjustment, see discussion infra.

Horizontal basketball rim support bar 19 is approximately 3 and ⅛ feet in length. FIG. 6 is the front view of my preferred embodiment and how horizontal basket ball hoop support bar 19 is attached to upwardly protruding vertical basketball hoop bars 41*a*, 41*b* each by T-joint connectors 42*a*, 42*b* respectively. In FIG. 22, upwardly protruding vertical basketball hoop support bars 41*a*, 41*b* are seen in side isolated view.

Basketball hoop support stands 79*a*, 79*b* statically contact bars 41*a*, 41*b*, and oppose forces upon bars 41*a*, 41*b* respectively, thus maintaining equilibrium within my invention.

Figure 16:
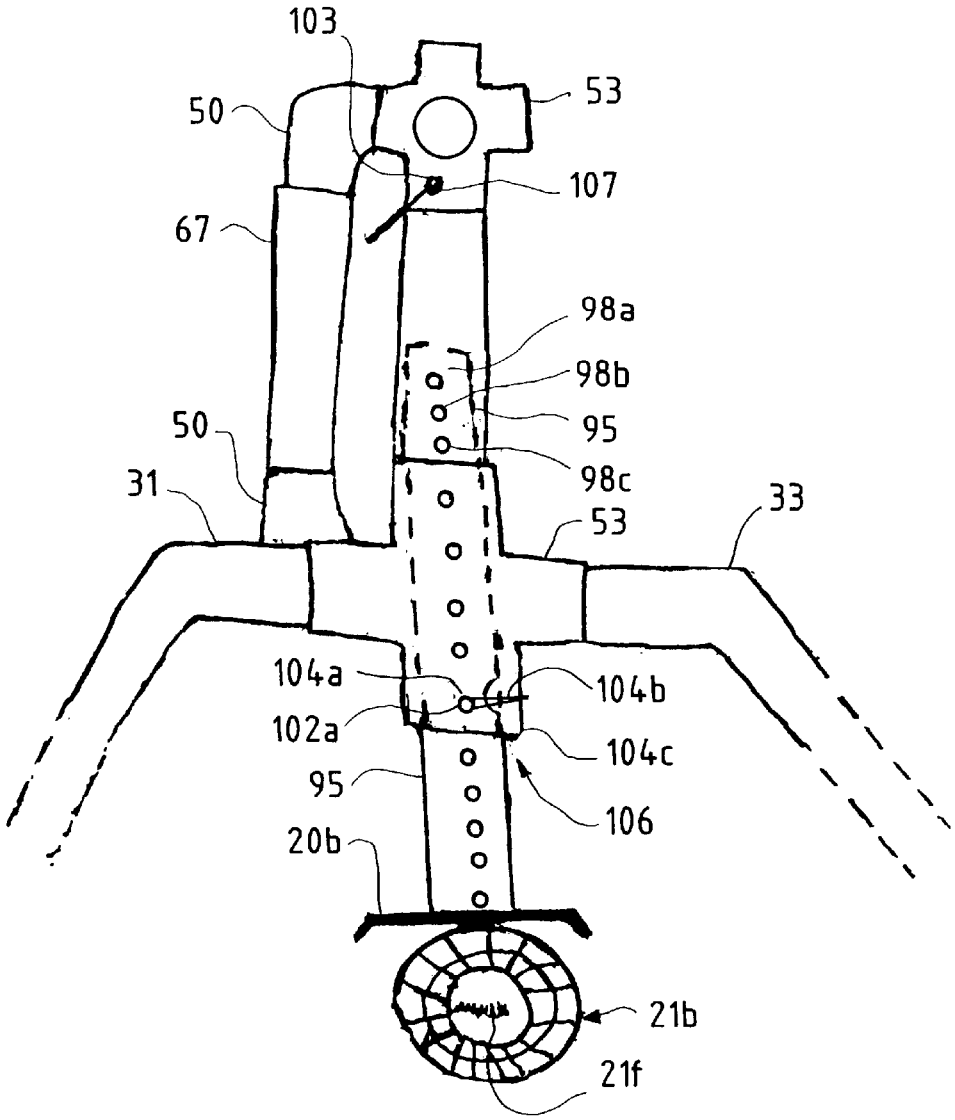
FIG. 16(*a*): Top plan view of center basketball hoop with adjustable anterior-posterior attachment.
Figure 16:
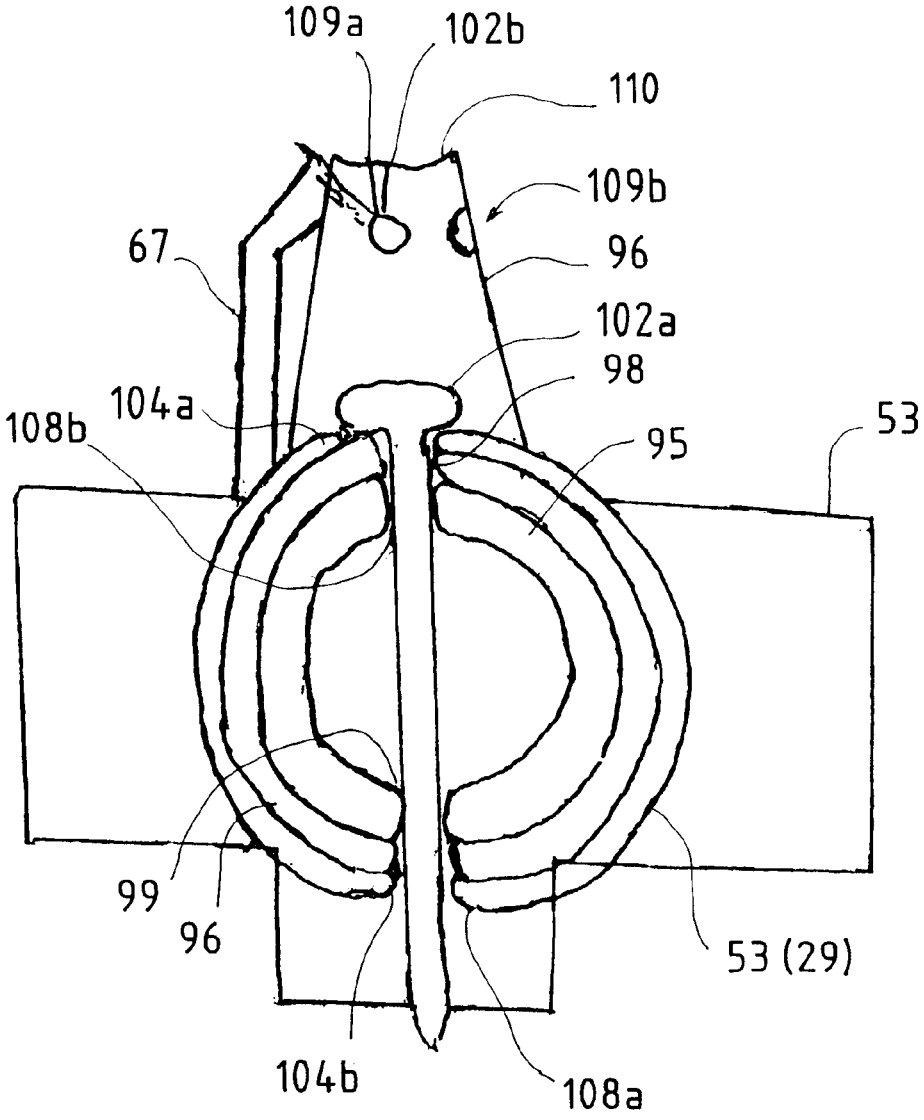

Referring to FIGS. 4 and 11, horizontal rigid basketball hoop support bar 19 lies beneath anteriorly protruding common stem 29. Common stem 29 in turn comprises a pre-fabricated four sided connector 53. Referring now to FIGS. 16(*a*), 28(*a*) and 28(*b*). There are three prongs 31,32, 33, a central basketball hoop 21*b*, and two lateral basketball hoops 21*a*, 21*c*. Attached posteriorly to each basketball hoop is backboard 20*a*, backboard 20*b*, and backboard 20*c*, respectively.

Figure 5:
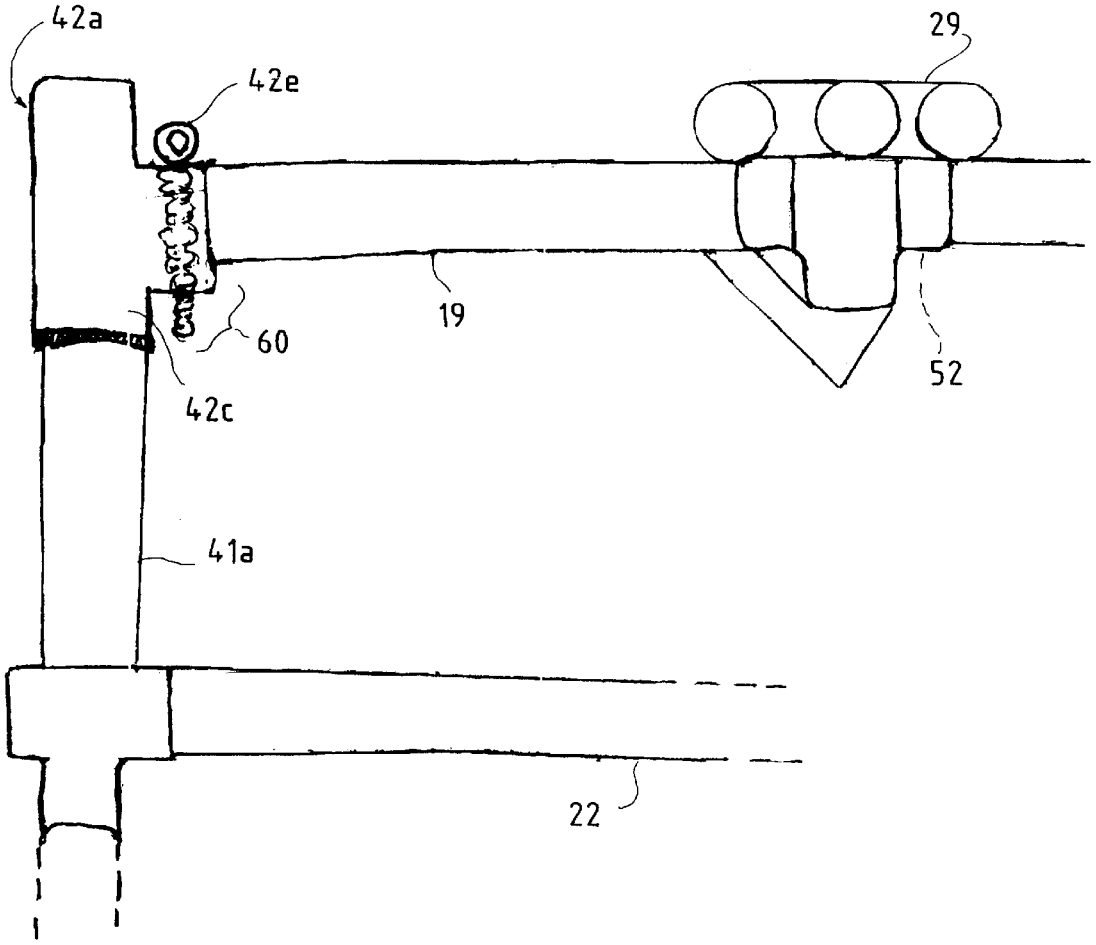
FIG. 5: Front closeup view of T-joint and horizontal basketball hoop support bar with metal pin.
Figure 23:
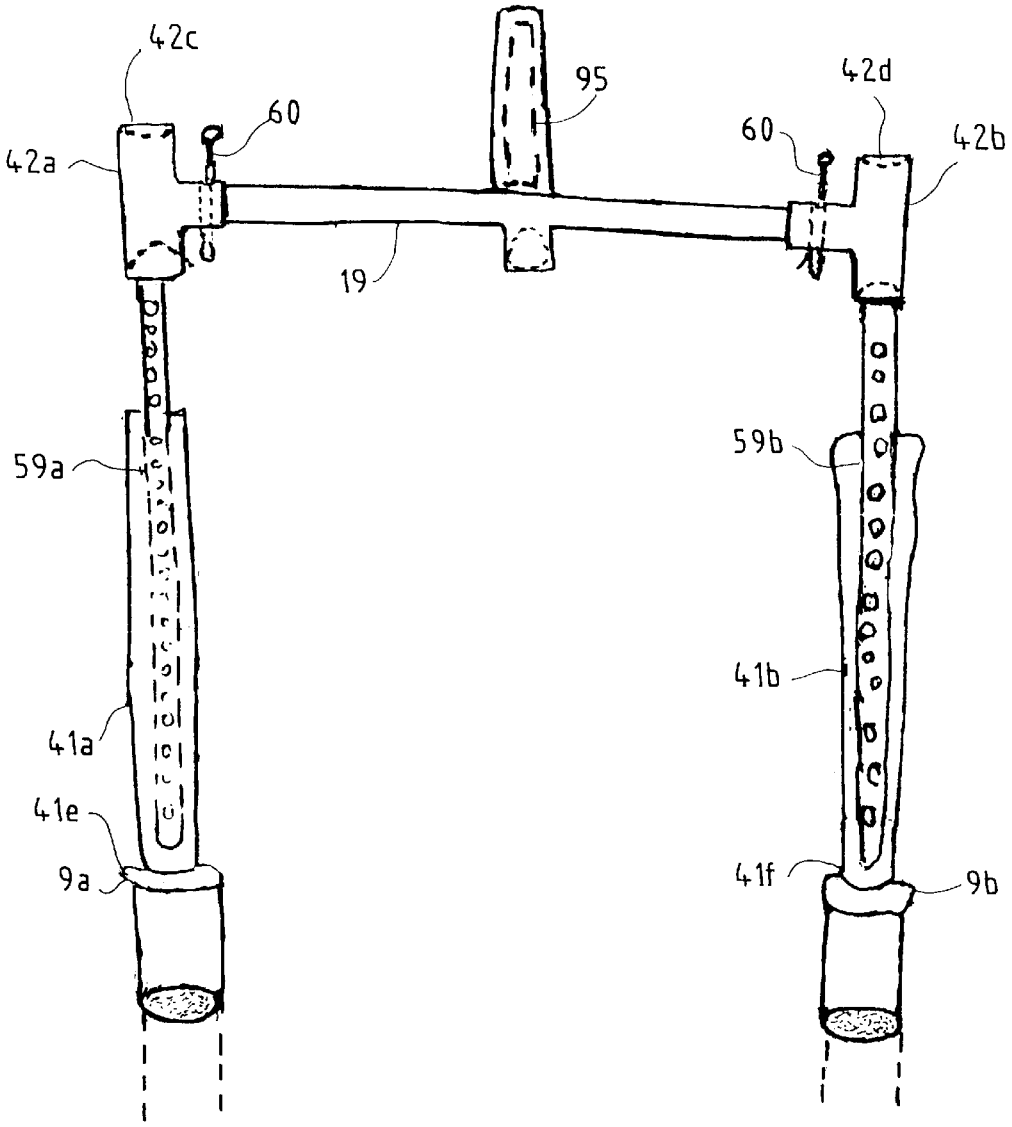
FIG. 23: Front isolated view of upwardly protruding rigid basketball hoop height adjustor bars with pin/pinhole mechanism.

As seen in FIGS. 5 and 23, T-joint connectors 42*c*, 42*d* are at either ends a,42*b* (not seen) of horizontal basketball hoop support bar 19. Screws with threaded stems 60 completely penetrate each T-joint connector 42*c*, 42*d* and each end respectively of horizontal basketball hoop support bar 19. By penetrating each T-joint connector 42*c*, 42*d* and horizontal basketball hoop support bar 19 completely, screws with threaded stems 60 provide additional frictional resistance to downward forces on horizontal basketball hoop support bar 19.

Figure 28:
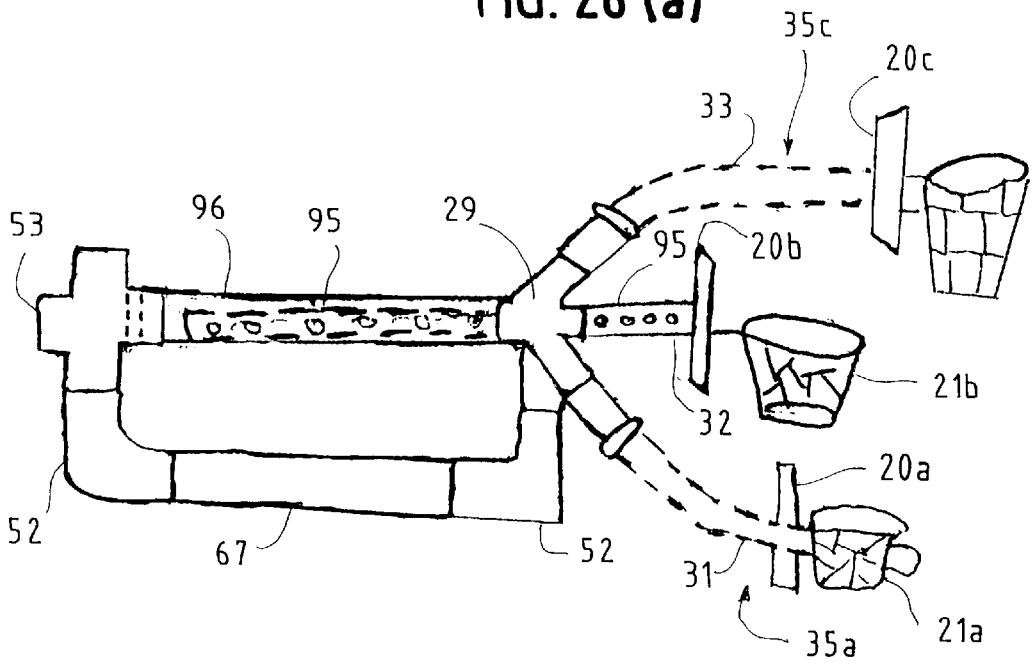
FIG. 28(*a*): Isolated closeup partial front view of three basketball hoops with anterior-posterior length adjustor bar, common stem and lower anterior-poster support bar.
Figure 28:
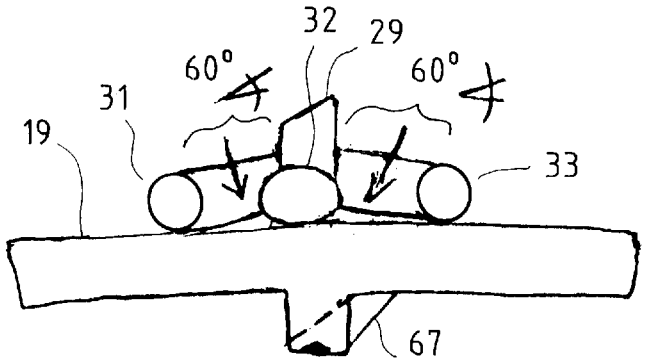

As best seen in FIGS. 28(*a*) and 28(*b*) my preferred embodiment comprises three basketball hoops 21*a*, 21*b*, 21*c*. Hoops 21*a*, 21*b*, 21*c* are indirectly attached to basketball hoop horizontal support bar 19(not seen). Each basketball hoop 21*a*, 21*b*, 21*c* is connected to one prong 31, 32, 33 respectively through extension bars 35*a*, 35*b*, 35*c* respectively.

Each prong 31, 32, 33 in turn is physically attached to common stem 29 through a four opening prefabricated joint 53. Anterior-posterior adjustment bar 95 moves central basketball hoop 21*b* linearly backwards and forwards (anteriorly and posteriorly). There is also swiveling means 70 for adjusting basketball hoop angular divergence for lateral basketball hoops 21*a*, 21*c*.

Figure 20:
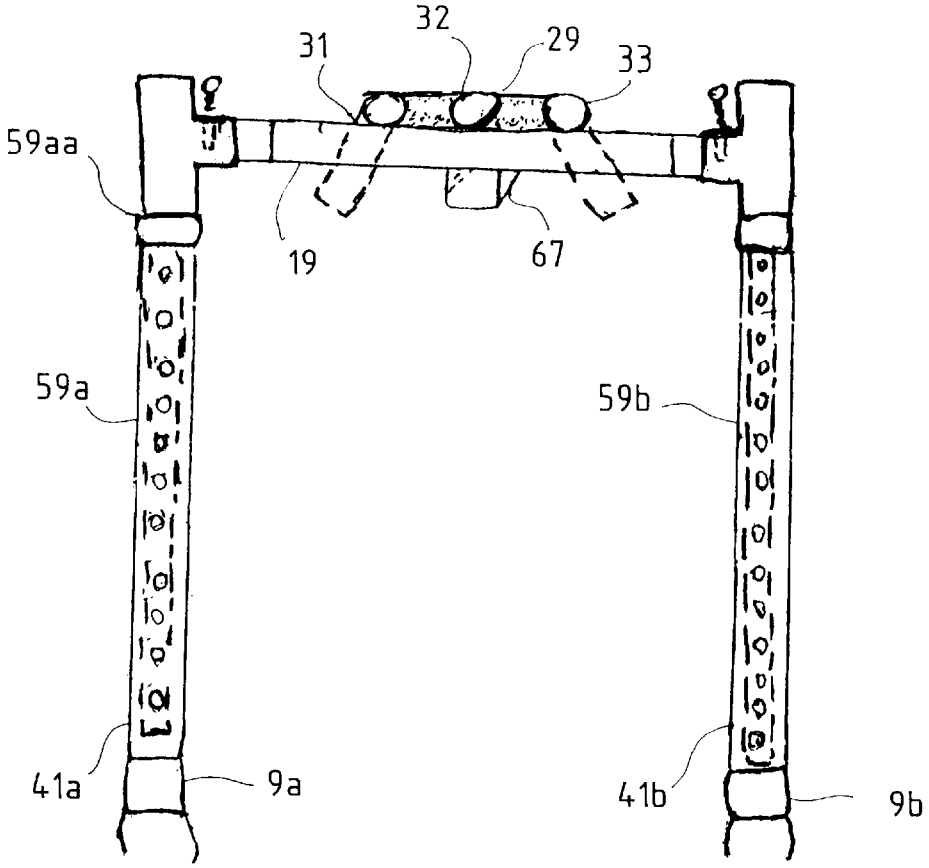
FIG. 20(*a*): Front view of two upwardly protruding basketball hoop vertical support bars comprising vertical basketball hoop height adjustor bars within, and horizontal basketball hoop support bar.
Figure 20:
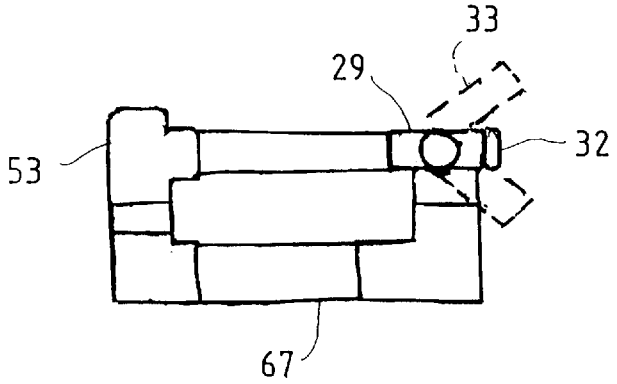

As seen in FIG. 20(*a*), each upwardly protruding vertical basketball rim support bar 41*a*, 41*b* comprises an adjustment bar 59*a*, 59*b* respectively for changing vertical height of basketball hoops 21*a*, 21*b*, 21*c*(not seen). FIG. 20(*b*) illustrates in side view how common stem 29 and basketball hoop prongs 31, 32, 33 are supported by U-shaped lower basketball hoop support bar 67.

FIG. 16(*a*) is a top plan view of center basketball hoop 21*b* in my preferred embodiment 1. Center basketball hoop 21*b* is retracted posteriorly or extended anteriorly with anterior-posterior adjustment bar 95, shown here in closeup.

Figure 15:
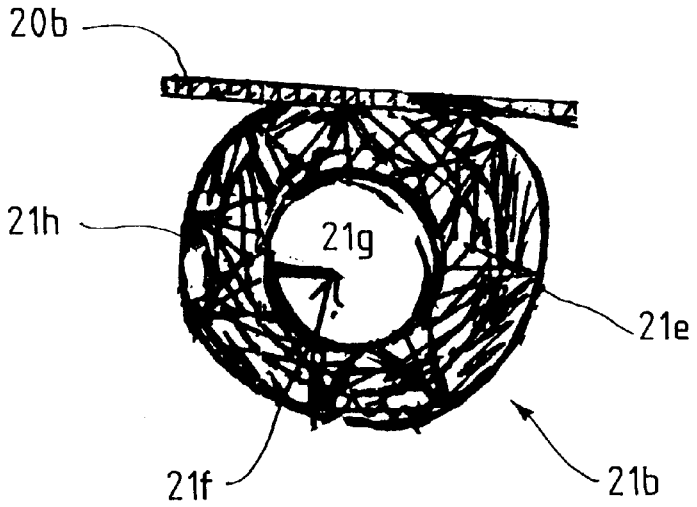
FIG. 15(*a*): Top plan view of basketball hoop with spring attachment and backboard.
Figure 15:
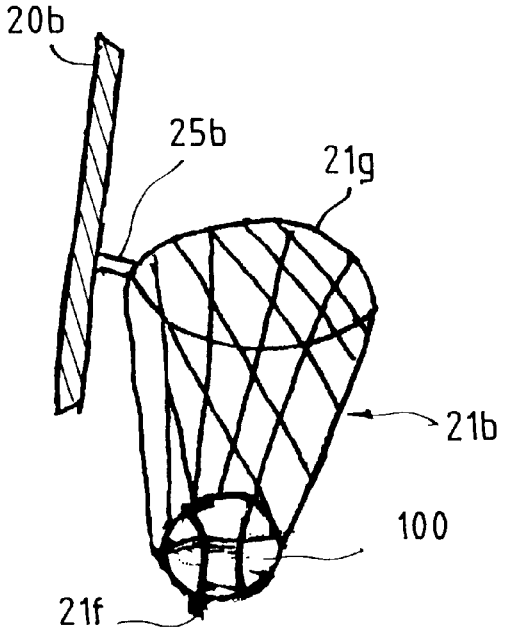
Figure 15:
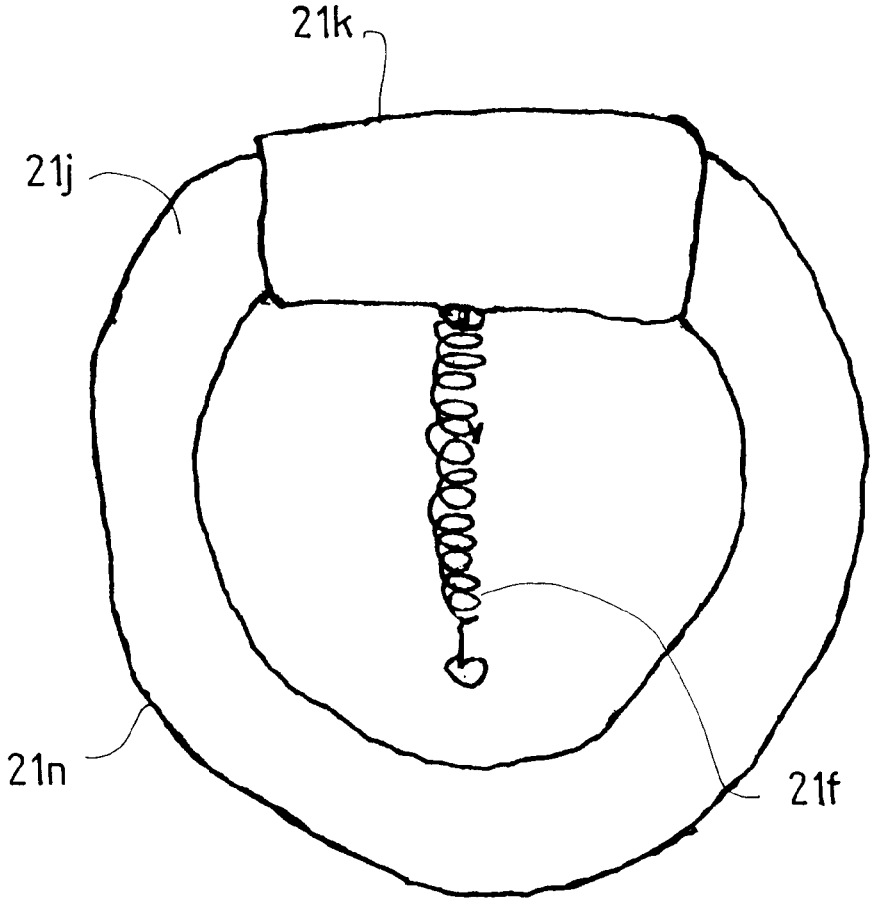

Referring to FIGS. 15(*a*) and 15(*b*), each of the three basketball hoops 21*a*(not seen), 21*b*, 21*c*(not seen), comprise a spring device 21*f* located at the bottom 21*g* of each basketball net 21*e*. Spring attachment 21*f* prevents a ball 100 from bouncing from any basketball hoop 21*a*, 21*b*, 21*c* and disrupting the routine of the operator.

As seen schematically in FIG. 15(*c*), electric tape 21*k* secures and fastens spring attachment f onto elastic band 21*n*. Band 21*n* forms base 21*g* of basketball hoop 21*a*, 21*b*, 21*c*. Elastic band 21*n* comprises upper side 21*j* of velcro® to maintain elastic band 21*n* intact. Velcro can be purchased from:

Velcro U.S.A., Inc.
406 Brown Ave.
Manchester, N.H. 03103
Telephone: 1-800-225-0180
Fax: 1-800-835-2761

Velcro hook material generally comprises a base sheet material with stemlike projections. Suitable hook materials generally comprise approximately 300 to about 1000 hooks per square inch, preferably from about 700 to about 900 hooks per square inch.

Hooks have a height of from about 0.015 inch, preferably from about 0.024 inch to about 0.035 inch. The lower surface of the tape has a self-adhesive application.

Referring again to FIG. 4, each upwardly protruding vertical basketball hoop support bar 41*a*, 41*b* has upper ends 41*c*, 41*d* to which horizontal support bar 19 is connected by T-joint connectors 42*c*, 42*d*. Common stem 29 is physically oriented at approximately a right angle to horizontal basketball hoop support bar 19.

Referring again FIGS. 28(*a*) and 28(*b*), common stem 29 (comprised primarily of four member prefabricated connector 53) branches anteriorly into three prongs: 31, 32, 33. Each prong 31,32,33 is hollow, and comprises further lateral attachments at their most distal ends. Each basketball hoop 21*a*, 21*b*, 21*c* is physically attached to each backboard 20*a*, 20*b*, 20*c* respectively by a particle board square 44 which is approximately ¾ inch thick. Basketball hoops 21*a*, 21*c* are adjustable vertically and horizontally. Central basketball hoop 21*b* is adjustable vertically and in a posterior-anterior direction.

Figure 17:
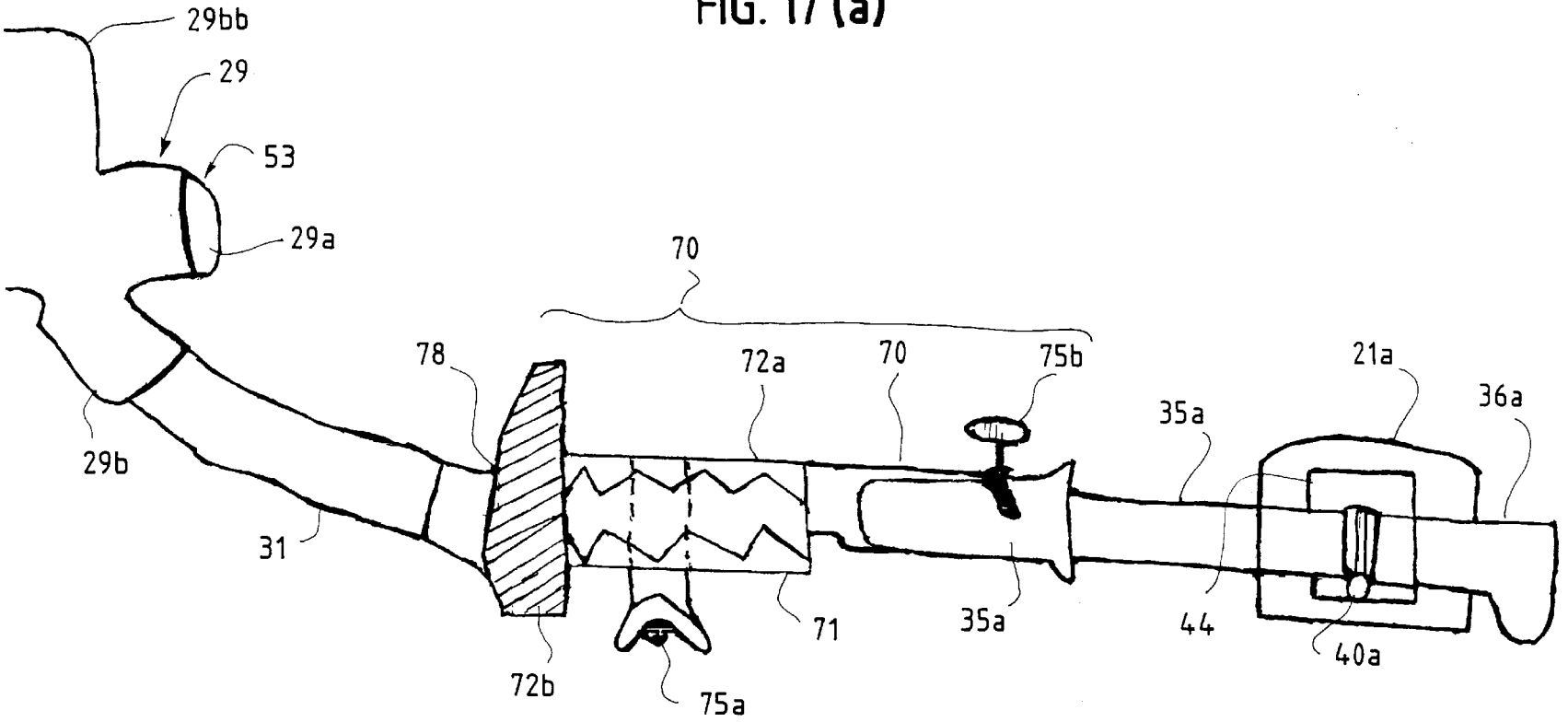
FIG. 17(*a*): Isolated side view of basketball hoop mechanism for lateral adjustment.
Figure 17:
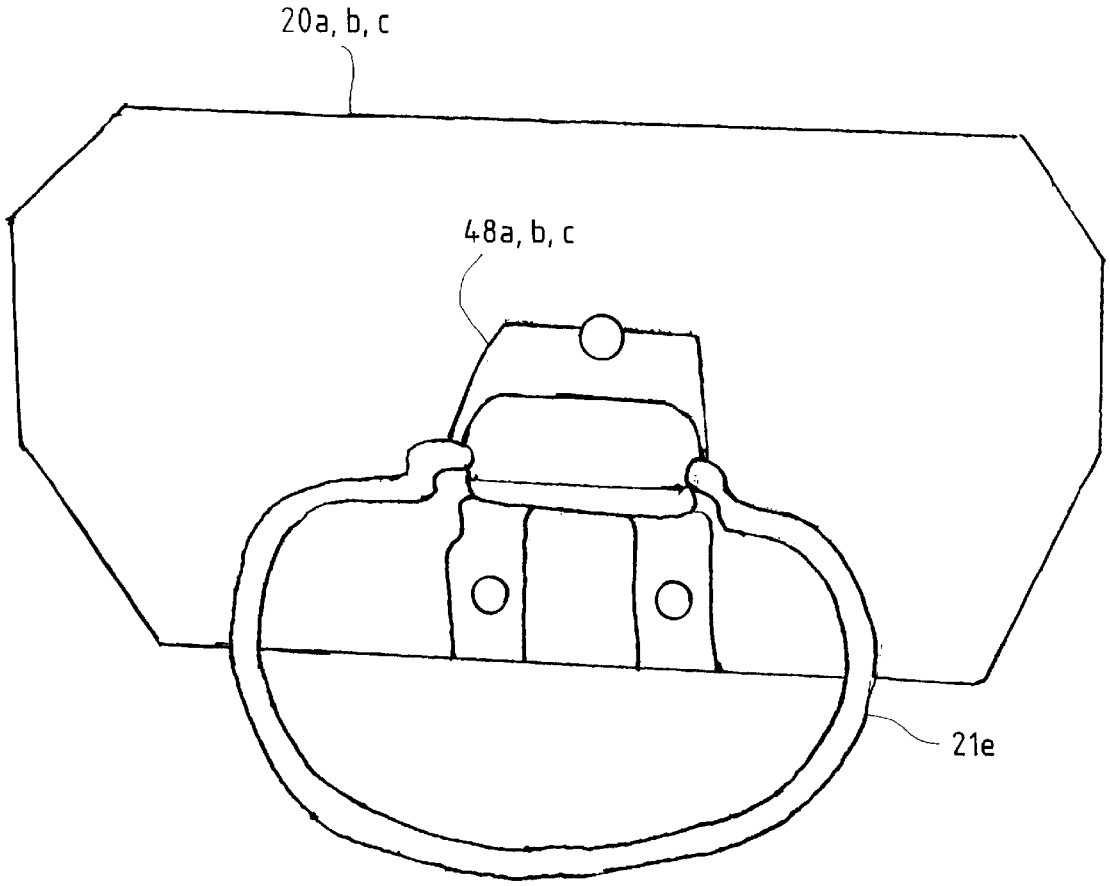

Referring now to FIG. 17(*a*), physically attaching each backboard 20*a*, 20*b*, 20*c* to extension bars 35*a*, 35*b*, 35*c* respectively are brackets 40*a*, 40*b*, 40*c* respectively.

Figure 13:
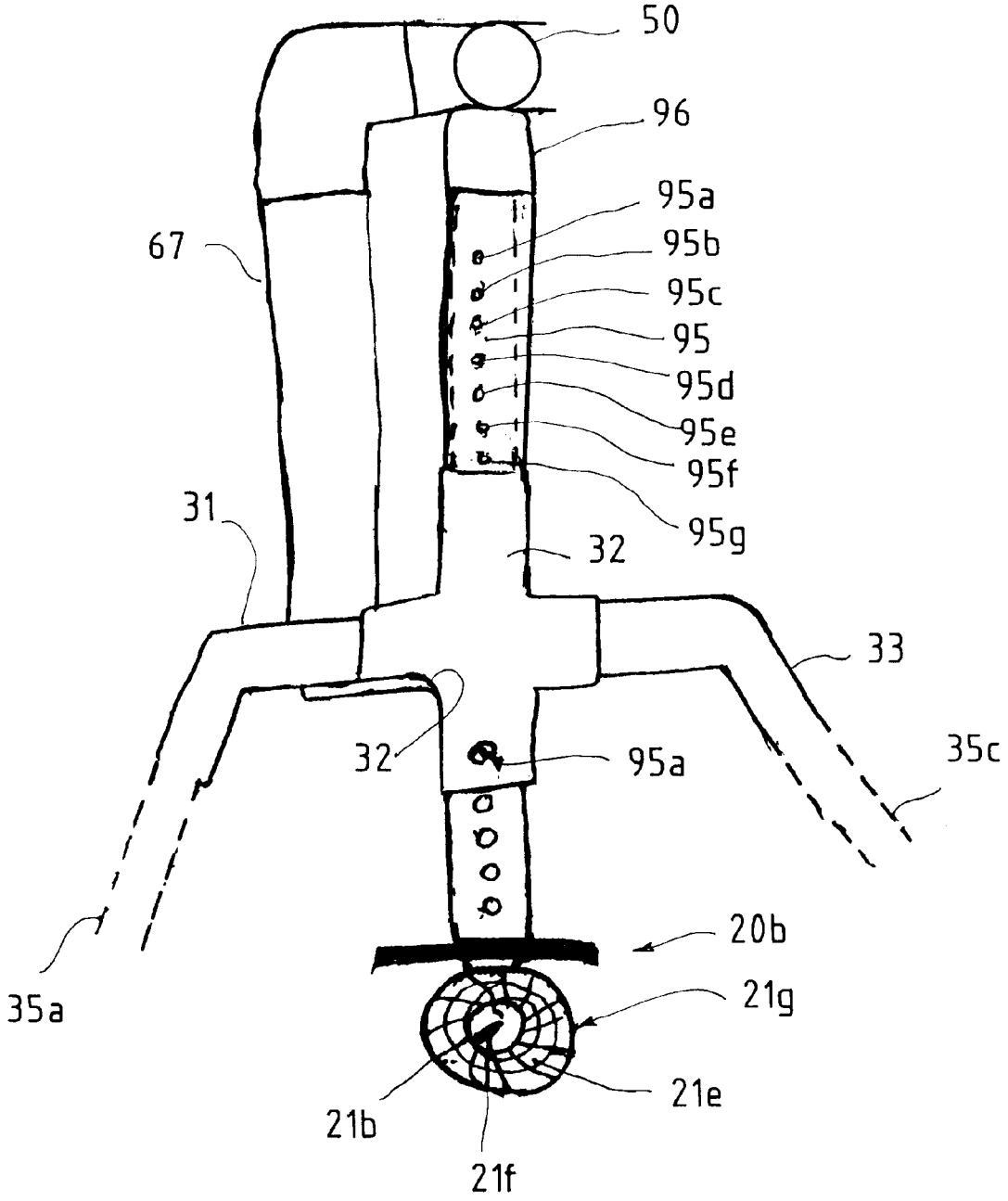
FIG. 13: Top plan view of center basketball hoop and anterior-posterior adjustor.

A plastic clasp 48*a*, 48*b*, 48*c* is screwed into each backboard 20*a*, 20*b*, 20*c* respectively to attach each plastic basketball hoop 21*a*, 21*b*, 21*c* respectively securely thereto. Please see FIG. 17(*b*). Each backboard 20 is attached to outward reaching extensions 35*a*, 35*b*, 35*c* respectively at each of their most posterior ends 36*a*, 36*b*, 36*c*. Please also see FIG. 24(*a*). FIG. 13 illustrates center basketball hoop 21*b* with backboard 20*b*. Prongs 31, 32, 33 are visible as well as anterior-posterior adjustor bar 95.

Upwardly protruding vertical basketball hoop support bars 41*a*, 41*b* and horizontal footstand support bar 22 are adjustable in a vertical direction. FIG. 5 illustrates vertical upwardly protruding basketball hoop support bar 41*a*, common stem 29 and horizontal basketball hoop support bar 19. Common stem 29 protrudes anteriorly across horizontal basketball hoop support bar 19. FIG. 5 additionally illustrates a closeup front view of T-joint connectors 42*c* which is at ends 42*a* of horizontal basketball hoop support bar 19. The same is true of end 42*b* with T-joint connector 42*d* in symmetrical orientation and construction.

Again referring to FIG. 5, common stem 29 physically traverses approximate midpoint 52 (not seen) of horizontal basketball hoop support bar 19.

T-joint connectors 42*c*, 42*d*(not seen) provide resistance to downward force from common stem 29. As seen in FIG. 22, lower ends 41*f*, 41*g* of upwardly protruding vertical basketball hoop support bars 41*a*, 41*b* reversibly yet tightly fit into cylindrical rigid hollow upwardly protruding joints 9*a*, 9*b*.

Figure 7:
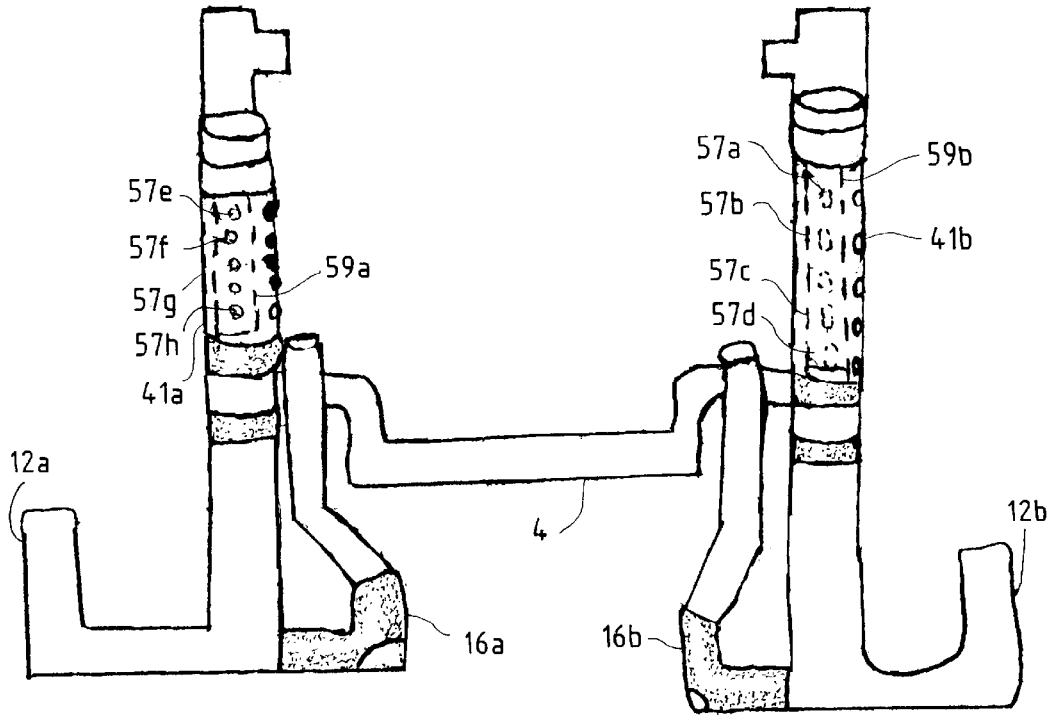
FIG. 7: Partial view of base, horizontal base bar, and vertical basketball hoop height adjustors.
Figure 7:
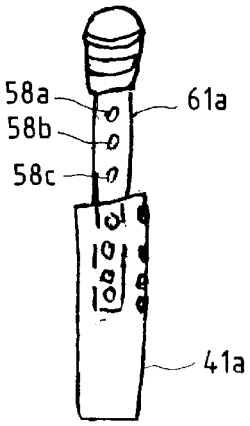

FIGS. 7(*a*) and 7(*b*) illustrate a partial front isolated view of my basketball hoop vertical height adjuster bars 59*a*, 59*b* which are each are approximately 15(fifteen) inches in length. FIG. 23 also illustrates a front view of vertical basketball hoop height adjustor bars 59*a*, 59*b*. Vertical height basketball hoop adjustor bars 59*a*, 59*b* are cylindrical bars, each with two sets of generic pinholes 57,55 and 58,56 respectively. Please also see FIGS. 14(*a*) and 14(*b*).

Generic pinhole sets 57,55, and 58,56 are approximately 180 degrees apart in two linear alignments along the length of each adjustor bar 59*a*, 59*b* respectively. Each adjustor bar 59*a*, 59*b*, also slides into and from each upwardly protruding vertical basketball hoop support bar 41*a*, 41*b*, respectively. Each adjustor bar 59*a*, 59*b* has upper end 42*h*, 42*i* respectively, firmly but reversibly attached within interior 44 of each T-joint connector 42*c*, 42*d*. In addition, each adjustor bar 59*a*, 59*b* can be pulled from or pushed into interior 44 of each T-joint connector 42*c*, 42*d* in which each adjustor bar 59*a*, 59*b* terminates.

FIG. 7(*a*) and FIG. 7(*b*) is a front view of basketball hoop vertical height adjustor 59*a*, 59*b*. As seen in FIG. 23, each vertical basketball hoop height adjustor bar 59*a*, 59*b* is itself a bar with linearly and vertically aligned pinholes 57.55 and 58,56 approximately ½ inch apart. Each vertical basketball hoop adjustor bar 59*a*, 59*b* is slidably attached to hollow T-joint connectors 42a,42*b* and upper ends 41*j*, 41*k* of vertical upwardly protruding basketball hoop support bars 41*a*, 41*b*.

Each vertical basketball rim height adjustor 59*a*, 59*b* contains pinholes 57*a*, 57*b*, 57*c*, 57*d*, 57*e*, 57*f* or 57*g*, etc. (generically pinholes 57), 58*a*, 58*b*, 58*c*, 57*c*, 58*d*, 58*e*, etc. respectively (generically pinholes 58), 55*a*, 5*b*, 55*c*, 55*e*, 55*f*, etc. (generically pinholes 55) or 56*a*, 56*b*, 56*c*, 56*d*, 56*e*, etc.(generically pin holes 56). Please see FIGS. 14(*c*) and 14(*d*). The opposite side of pinholes 57 comprise pinholes 55*a*, 55*b*, 55*c*, 55*d*, 55*e*, etc.(generically pinholes 55), for example. in adjustor bar 59*a*.

Vertical basketball hoop adjustors 59*a*, 59*b* are pulled vertically from within upwardly protruding vertical basketball hoop support bars 41*a*, 41*b* respectively.

Pinholes 57,55, or 58,56(generically) in each vertical basketball hoop adjustment bar 59*a*, 59*b* are approximately ½ inch apart in each linear vertical alignment. Each pair of pinholes 57,55 or 58,56 are approximately 180 degrees apart in linear vertical alignment on each adjustor bar 59*a*, 59*b*. Lower ends 41*e*, 41*f* of vertical upwardly protruding basketball hoop support bars 41*a*, 41*b* always remain within upwardly protruding hollow cylindrical joints 9*a*, 9*b*. More or fewer corresponding pinholes 57,55, or 58, 56 are also within the scope of my invention.

Figure 14:
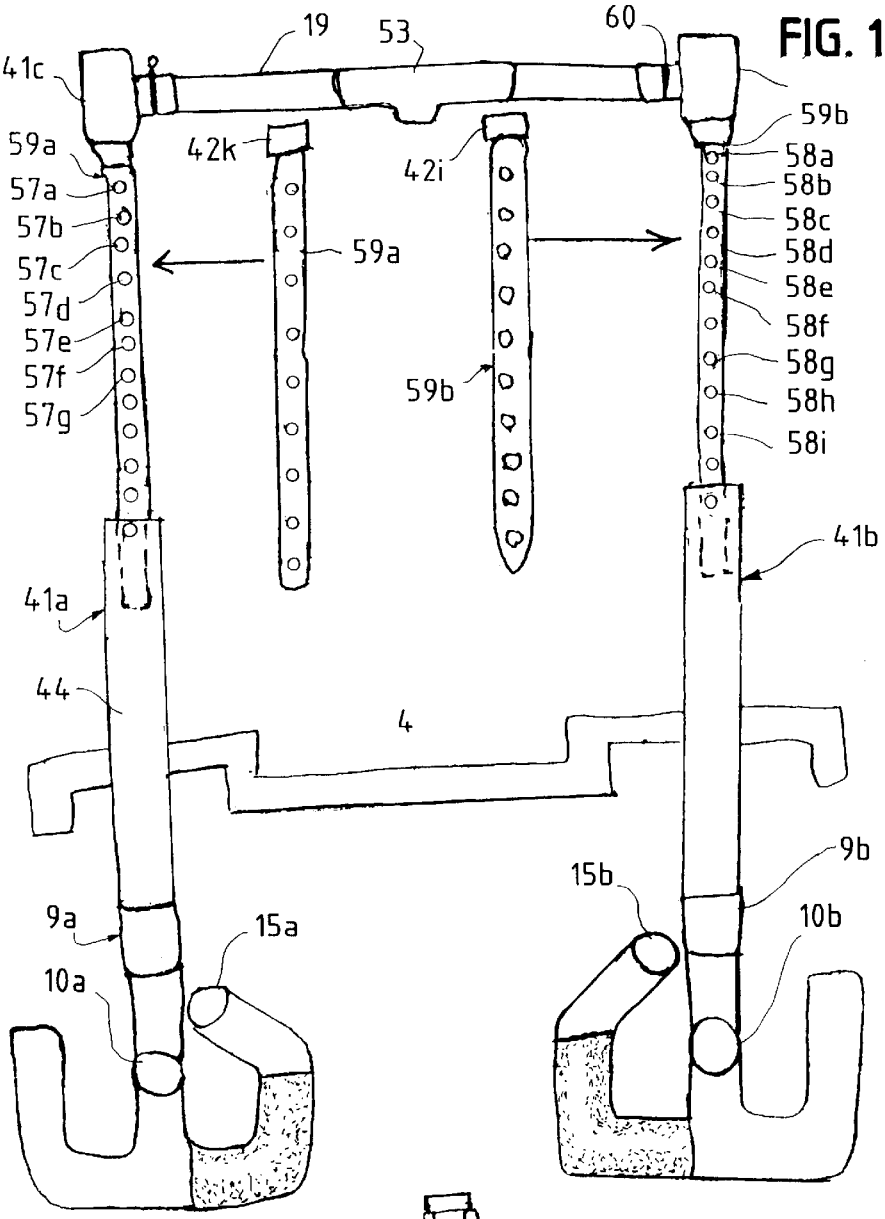
FIG. 14(*a*): Front view of horizontal basketball hoop support bar with vertical height adjustors.
Figure 14:
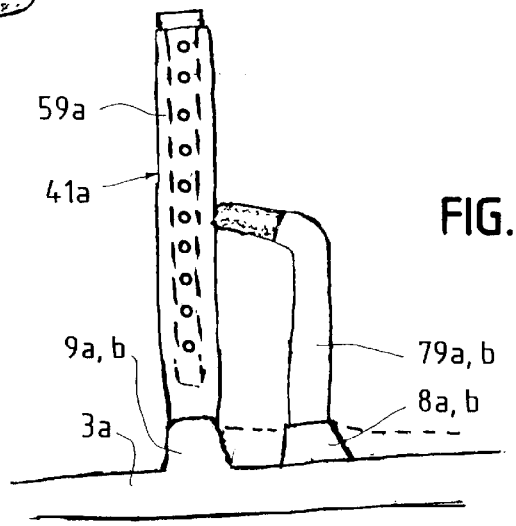
Figure 14:
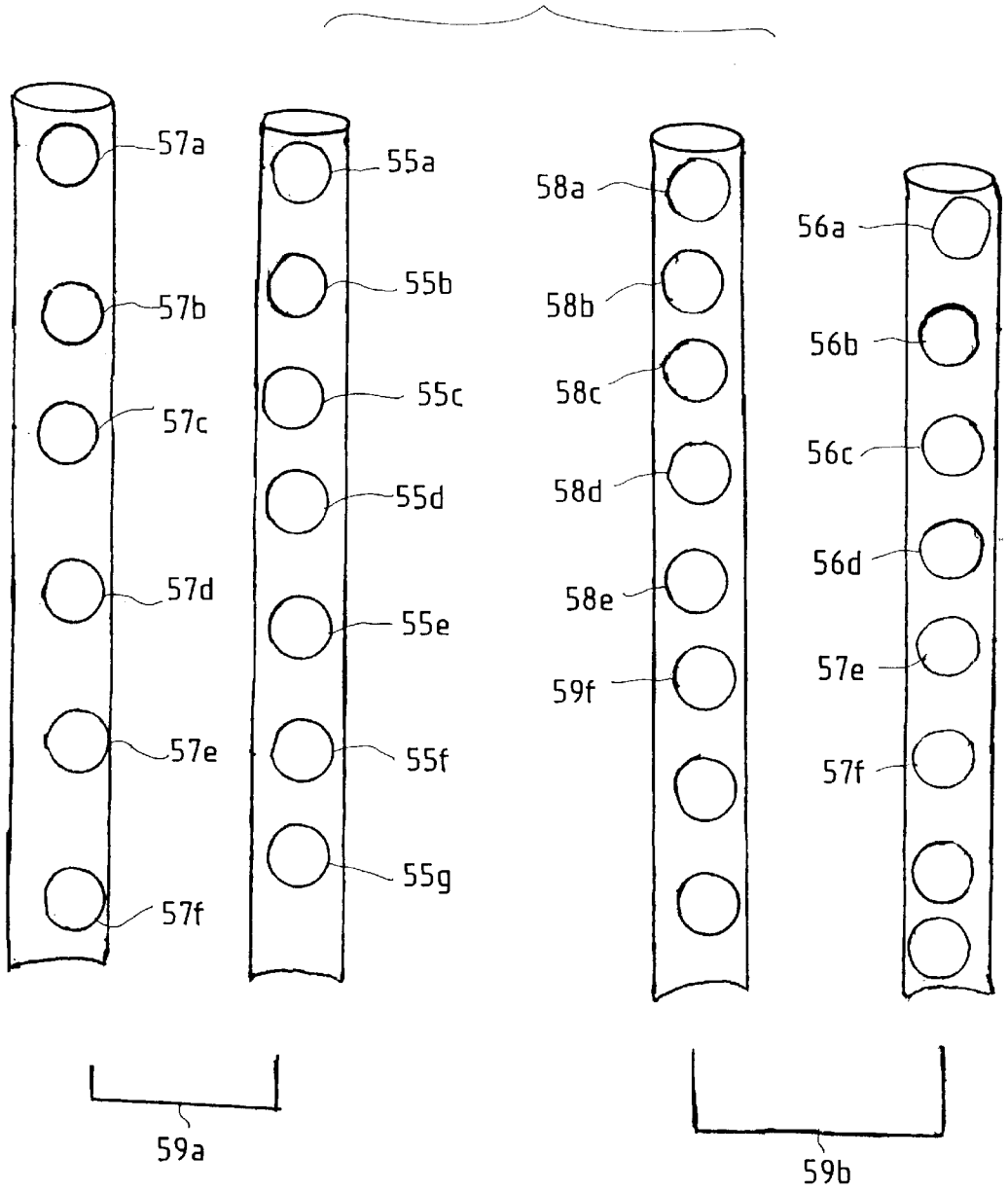
Figure 14:
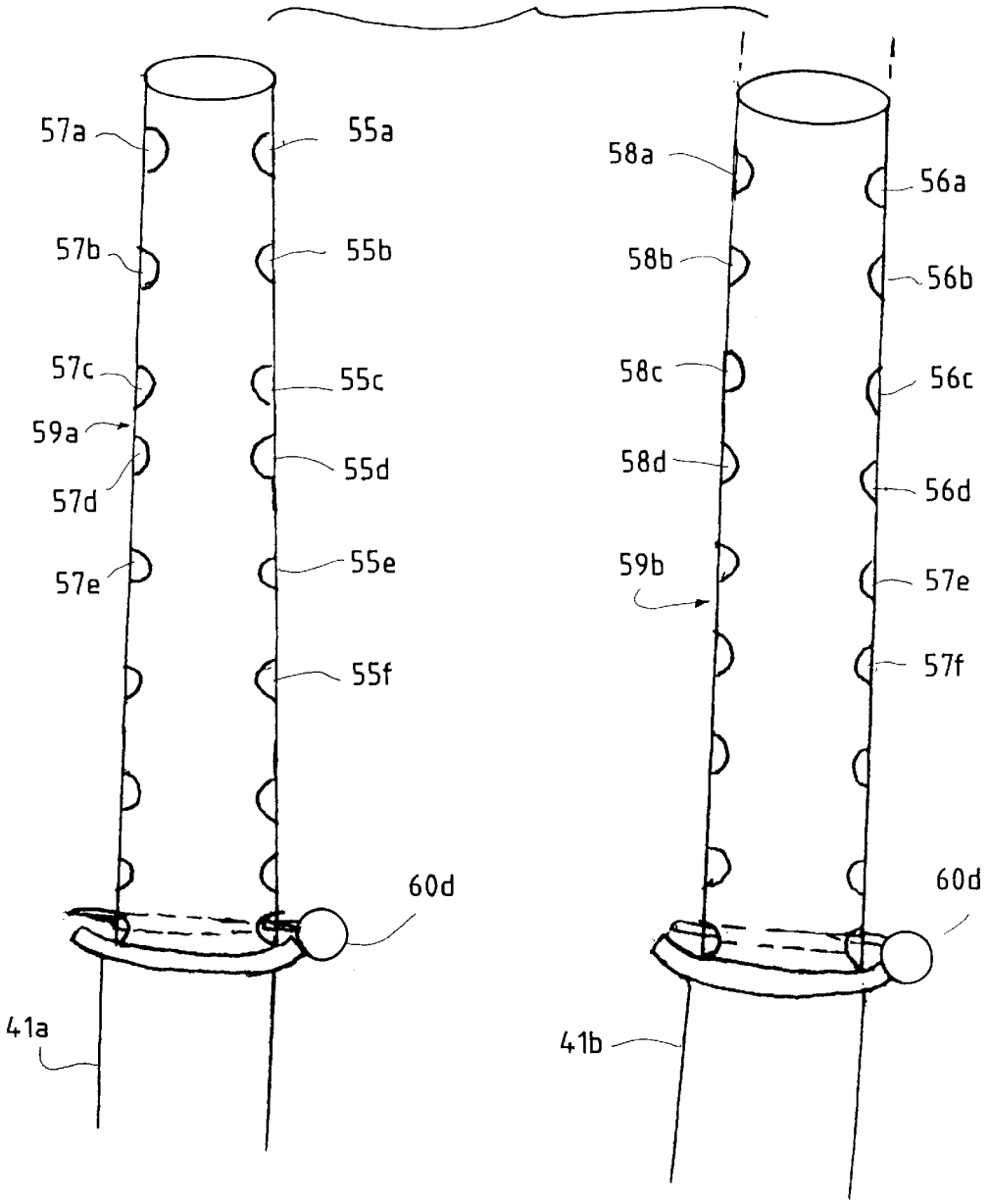
Figure 14:
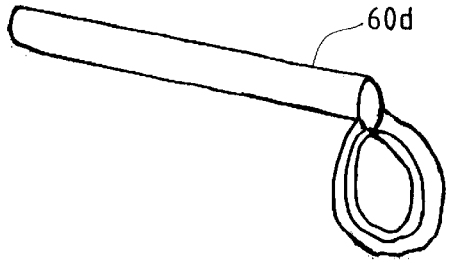

As seen in FIG. 7(*b*) each corresponding vertical height adjustment bar 59*a*, 59*b*(not shown) is pulled to a predetermined desired vertical height. Referring now to FIG. 14(*a*), to obtain this new predetermined vertical height, horizontal basketball hoop support bar 19 must be raised the same number of pinholes (assuming pinholes are as evenly spaced as possible and linearly aligned)on each upwardly protruding vertical basketball hoop support bar 41*a*, 41*b*.

For example vertical basketball hoop adjustor bar 59*a* is manually lifted from upwardly protruding basketball hoop vertical support bar 41*a*, until the two appropriate pinholes in adjustor bar 59*a* appear just above upper end 42*i* of upwardly protruding vertical basketball hoop support bar 41*a*.

The same procedure is followed for upwardly protruding vertical basketball hoop support bar 41*b*.

A long metal pin with a rounded tip d is then manually applied and penetrates both pinholes 57,55, or 58,56 in each adjustor bar 59*a*, 59*b*. In this position, each pin d rests upon each upper edge 41*i* and 42*j* of each upwardly protruding vertical basketball hoop support bar 41*a*, 41*b*. In this alignment, one metal pin 101 on each side of my invention is sufficiently strong to withstand the weight of horizontal basketball hoop support bar 19 as well as its attachments. Please see FIGS. 14*d*, 14*e*.

When height is to be increased or decreased to a new predetermined position, vertical basketball hoop adjustor bars 59*a*, 59*b* are again manually raised or lowered until appropriate pinholes 57,55 or 58, 56 reach just above upper ends 41*i*, 41*j* of upwardly protruding vertical basketball hoop support bars 41*a*, 41*b*. Please see also FIG. 23 (isolated front view of vertical basketball rim height adjustors 59*a*, 59*b*).

Again referring to FIG. 23, lower ends 41*e*, 41*f* of vertical upwardly protruding cylindrical support bars 41*a*, 41*b* are within upwardly protruding rigid hollow cylindrical joints 9*a*, 9*b*.

With the aid of screws 6, one of which is within each T-joint connectors 42*a*, 42*b*, horizontal basketball hoop support bar 19, is now held at a new predetermined height. FIG. 23 also illustrates how screws 60 are inserted through T-joint connectors 42*c*, 42*d*, and horizontal basketball support bar 19 for reinforcement at either end 42*a*, 42*b*.

Figure 10:
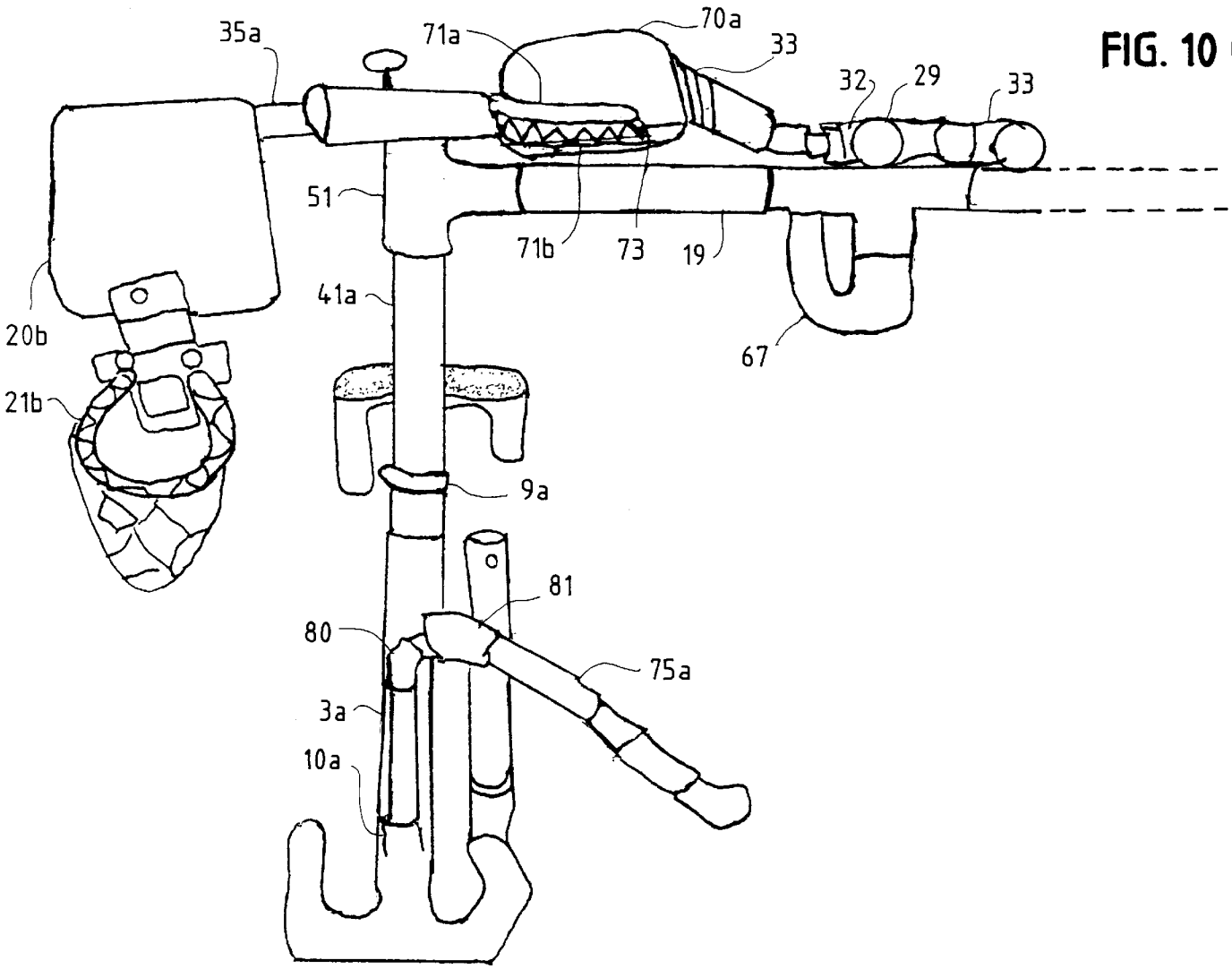
FIG. 10(*a*): Front view of invention illustrating isolated swivel attachment.
Figure 10:
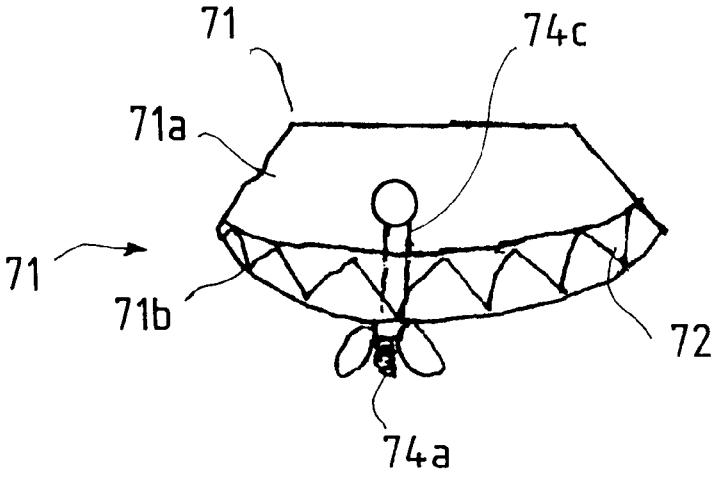
Figure 10:
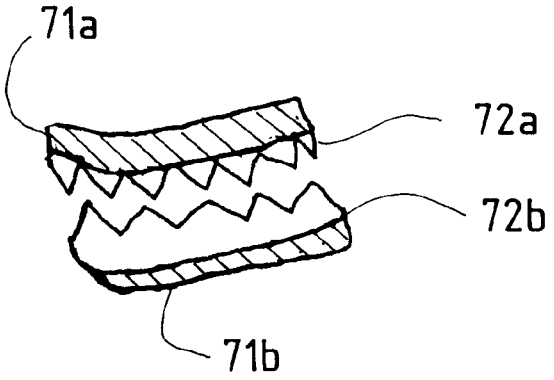

FIG. 10(*a*) is a front isolated view of lateral basketball hoop 21*a* attachments. The same lateral attachment description applies to lateral basketball hoop 21*c*. Attached to each prong 31,33 is swivel member 70 which rotates lateral basket ball rims 21*a* up to approximately 90 degrees. Swivel member 70 comprises a swivel mechanism 73 which rotates basketball hoop 21*a*, 21*c* to a desired predetermined position. Extension bars 35*a*, 35*c* are physically contiguous with swivel adjuster 70*a* or 70*c* and slide reversibly into and exteriorly to swivel adjustor 70*a* or 70*c*.

Each of the two swivel members 70 can rotate in a clockwise or counterclockwise direction to mechanically rotate basketball hoops 21*a* or 21*c*, as the case may be, to a new predetermined position. As seen in FIG. 10(*b*) swivel member 73 has an upper surface 71*a* and a lower surface 71*b*. Screw member 74*a* is securely fastened to lower surface 71*b*. Screw member 74*a* penetrates lower surface 71*b* and upper surface 71*a* with its threaded stem 74*c*.

When screw member 74*a* is manually twisted to become tighter in upper surface 71*a* and lower surface 71*b*, interlocking tooth members 72a,72*b* lock tightly together. Screw member 74*a* is loosened by manual rotation in the opposite direction. As screw member 74*a* progressively disengages from upper surface 71*a* and lower surface 71*b*, tooth members 72*a*, 72*b* disengage and allow slippage. Each screw member 74*a* loosens to allow extension bar 35*a* or 35*c* to rotate with screw stem 74*a* to a predetermined position for each lateral basketball hoop 21*a*, 21*c*.

FIG. 17(*a*) is an isolated side view of swivel adjustors 70 for either of each lateral basketball hoop 21*a*, 21*c*. Seen at the extreme left is prong 31 and common stem 29. Common stem 29 is comprised of pre-fabricated four-member joint 53, with each member having a hollow cylindrical interior 29*a*. Prongs 31,33 each extend from one joint member 29*b* or 29*bb*, and each enters a enters a 45 angle joint connector 52 and continues to swivel adjuster attachment 78.

Swivel adjustor attachment 78 is bound firmly with electrical tape 72*b*, and four screws 29*f*, 29*g*, 29*h*, 29*i* (not seen) to swivel member 70. Each swivel member 70 has a moveable joint 71 and tooth members 74*a*, 74*b*, described supra, for loosening joint 71 from a predetermined position.

Figure 24:
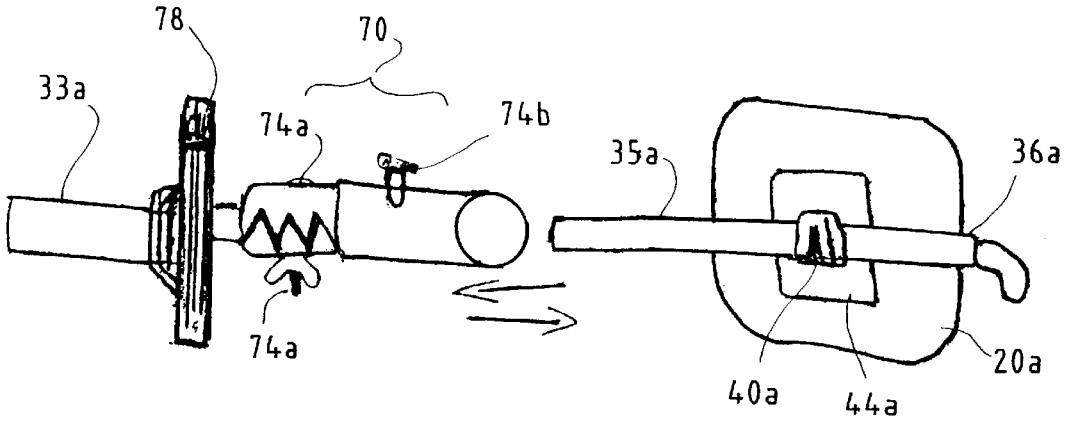
FIG. 24(*a*): Side detailed view of swivel mechanism for lateral basketball hoop movement.
Figure 24:
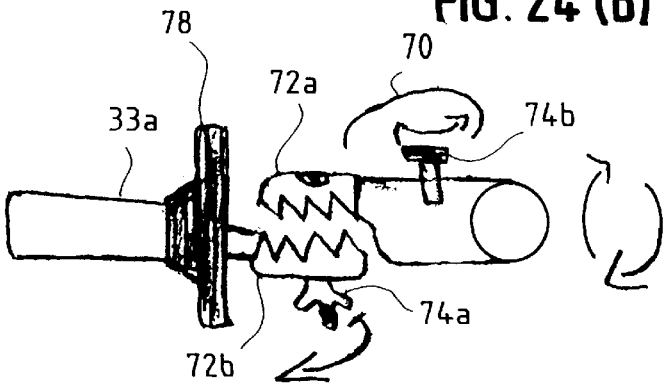

FIGS. 24(*a*) and 24(*b*) illustrate in side view swivel attachments 70 for basketball hoops 21*a* or 21*c*. FIGS. 24(*a*) a nd 24(*b*) also indicate anterior posterior movement of extension bars 35*a*, 35*c* when screw 74*b* is tightened or loosened. Screw 75 loosens swivel adjustor 70 to allow extension bar 35*a*, 35*c* to slip from within swivel adjustor 70 to change anterior-posterior position.

An adjustable nylon flag bracket is adapted as the swivel and angle adjustors and can be purchased from Yard Works, Inc. Electrical tape can be purchased from:

Gam Pack Products Corporation

475 Blay St.

Hillside, N.J. 07205

The most preferred tape from Gam Pack is 7 millimeter premium grade all weather electrical tape which is ¾ inch by seven thousands inch by 66 fee.

Again referring to FIG. 17(*a*) head screw 75*b* loosens to extend or retract extension bars 35*a*, 35*c*(with manual force). Screw 75*b* can then be tightened to keep basketball hoops 21*a*, 21*c* and backboards 20*a* rigidly in place in their new anterior-posterior positions.

Figure 18:
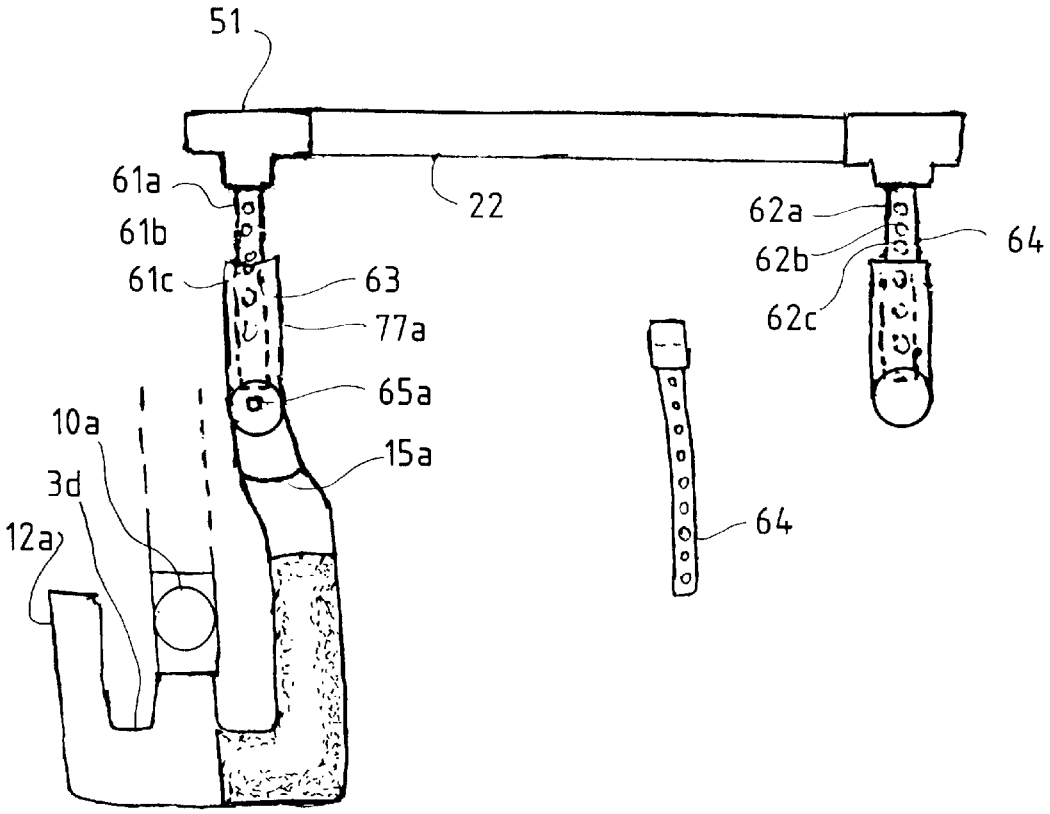
FIG. 18(*a*): Isolated view of foot stand horizontal bar and vertical upwardly protruding foot stand adjustors.
Figure 18:
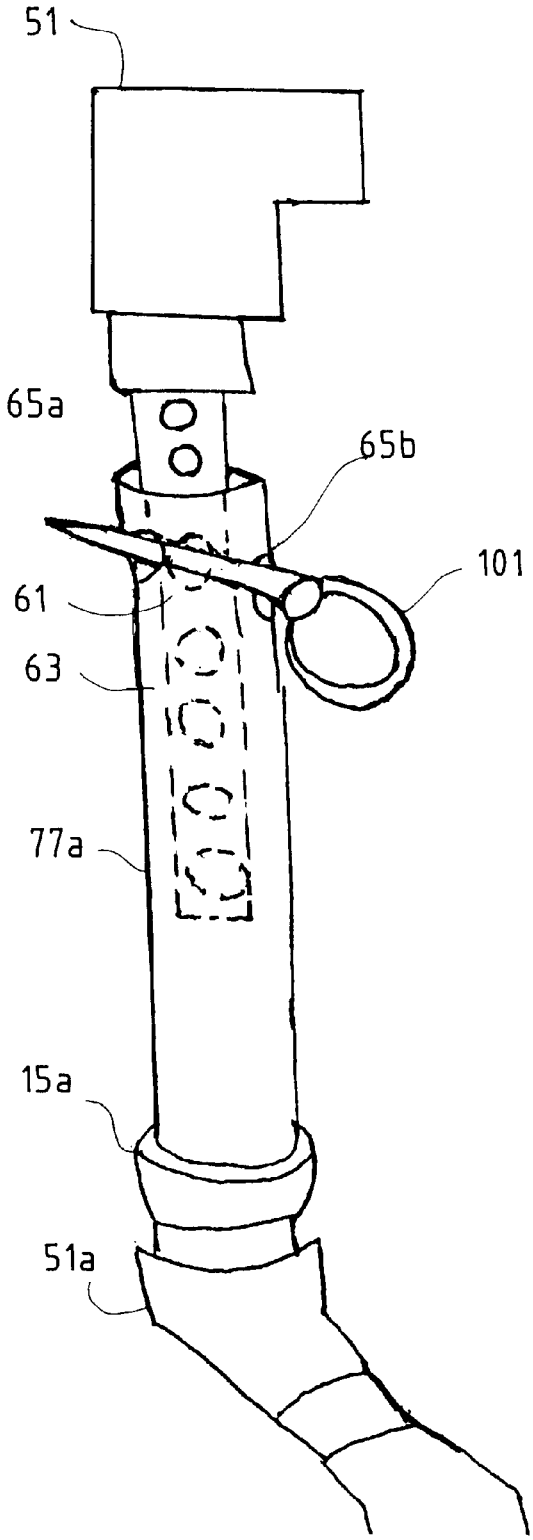
Figure 27:
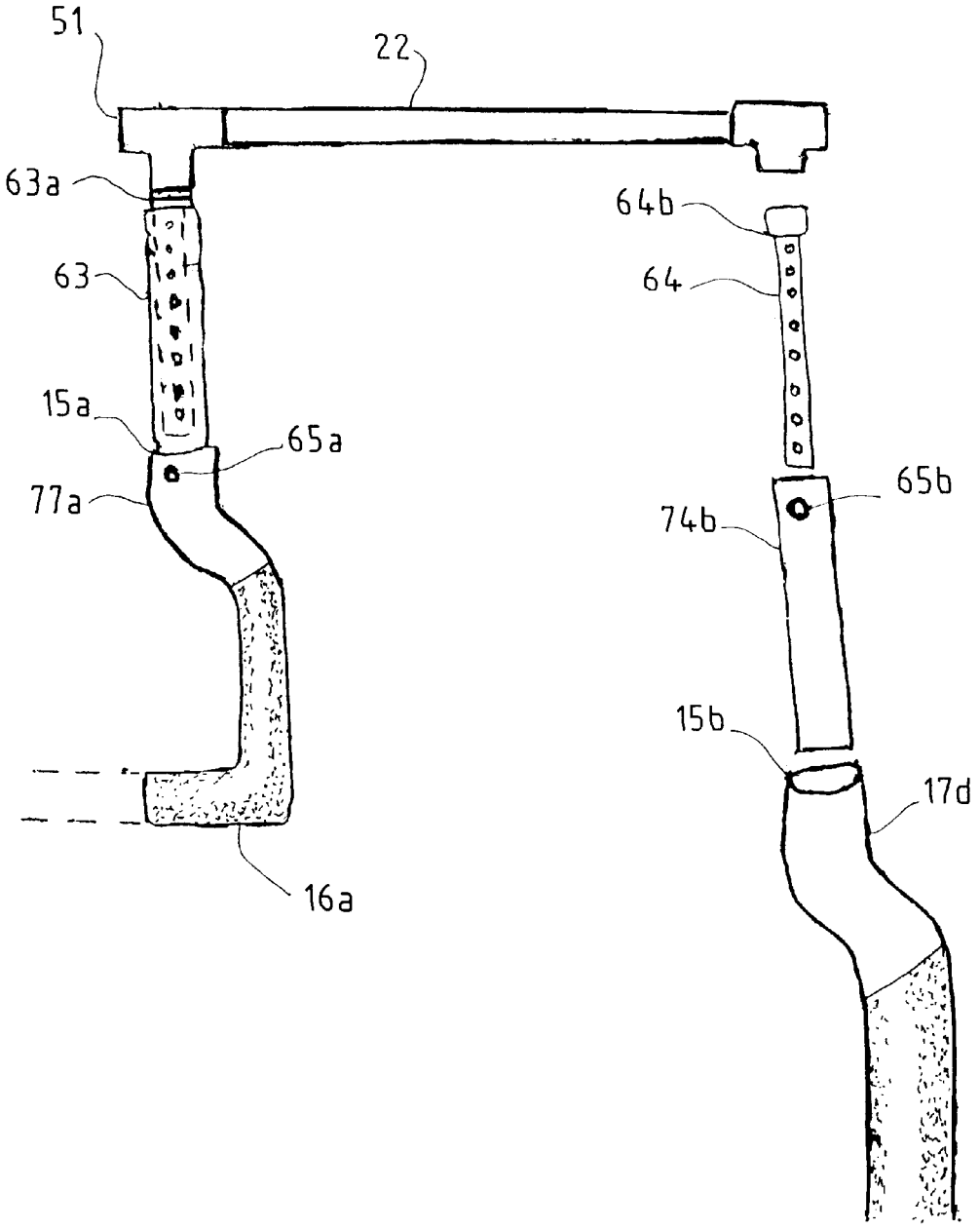
FIG. 27: Isolated front view of horizontal foot stand bar and attached vertical height adjustor with pin/pinhole mechanism.

FIG. 18(*a*) is partial isolated view of horizontal foot stand support bar 22 and base 2. Generic pinholes 61,62 in each vertical footstand adjustor support bar 63,64 respectively tare in vertical linear alignment. Consecutive pinholes 61,62 in alignment are approximately ½ inch apart in the preferred embodiment. Please also see FIG. 27. Horizontal footstand bar 22 is approximately 36 and ¼ inches in length in the most preferred embodiment.

Each of two T-joint connectors 51 physically attach horizontal footstand support bar 22 to each upper end 63*a*, 64*a* of each vertical footstand adjustor 63,64. Vertical footstand height adjustor support bars 63,64 are each approximately fifteen inches long vertically. Each vertical footstand adjustor bar 63,64 has vertically aligned pinholes 61*a*, 61*b*, 61*c*, etc.(generically 61) and 62*a*, 62*b*, 62*c*, etc.(generically 62)respectively. Universal pinholes 65*a*, 65*b*, are apertures drilled through each front and lateral side 64*a*, 64*b* respectively of each vertical footstand support bar 77*a*, 77*b* respectively.

Referring now to FIG. 18(*b*), to modify the height of horizontal footstand support bar 22, each vertical footstand adjuster bar is manually pulled from within each vertical footstand support bar 77*a*, 77*b*, to a new height.

At the desired predetermined height, one pinhole 61,62 emerging from each vertical footstand support bar 77*a*, 77*b* will align with two universal pinholes 65*a*, 65*b*. At the correct predetermined height, pin 101 a is thrust through universal pinholes 65*a*, 653*b* as well as the appropriate pinhole 61,62 on each respective vertical footstand height adjustment bar 63,64.

In sum, each of two round ended elongated pins 101 mechanically align:(i) two universal pinholes, approximately 180 degrees apart on each vertical foot stand support bar 77*a*, 77*b* with; (ii) a single pinhole 61,62 within each footstand vertical height adjustor bar 63,64 respectively. Round ended elongated metal pin 101 prevents slippage of horizontal footstand support bar 22 by supporting T-joint connectors 51 on either end of horizontal footstand support bar 22.

Figure 12:
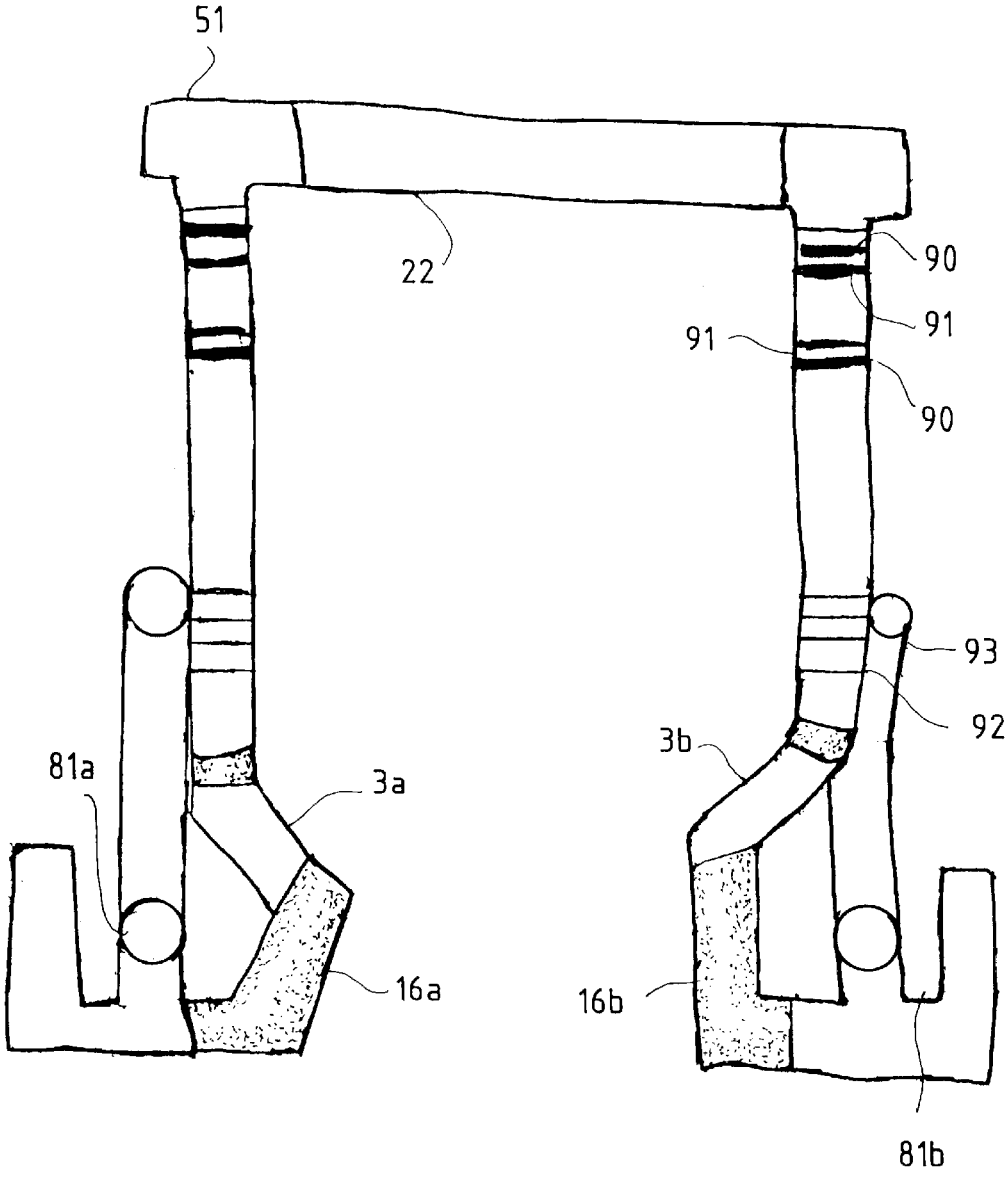
FIG. 12: Schematic partial front view of color coding bands.

Referring now to FIG. 12, there are circular color coded bands (generically 90) upon upwardly protruding cylindrical hollow joints 50 and other components of my invention 1. The user matches correctly colored ends of individual components to upwardly protruding rigid hollow cylindrical sockets 50 and other appropriate connecting means. My most preferred embodiment comprises the following color code:

Red tape color banding is 90;

Black tape color banding is 91

Blue tape color banding is 92;

Green tape color banding is 93.

As seen schematically in FIG. 12, joints with vertical members will correctly display a double band of the same color.

Figure 25:
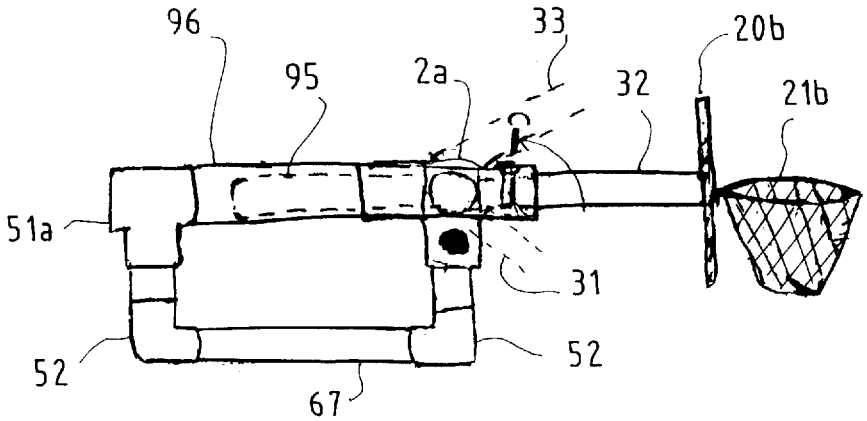
FIG. 25: Partial side view of anterior-posterior pinhole/pin mechanism for center basketball hoop.

As seen in FIG. 25, anterior-posterior position adjustor bar 95 is the portion of my invention 1 which moves central basketball hoop 21*b* in an anterior-posterior direction. As illustrated in FIG. 16(*a*), has pin 102*a* to stabilize anterior-posterior adjustor bar 95.

Universal pinholes 104*a*, 104*b*, are aligned approximately 180 degrees from each other approximately ¼ inch from edge 104*c* of protruding opening 106 of four-membered prefabricated joint 53. As seen in FIG. 16(*b*), a set of vertically and linearly aligned pinholes 98*a*, 98*b*, 98*c*, etc. (generically 98) and 99*a*, 99*b*, 99*c*, 99*d*, etc.(generically 99) respectively are drilled through anterior-posterior adjustor bar 95 at approximately 180 degrees from each other.

Anterior-posterior adjustor bar 95 within cylindrical elevated support bar 96 slidably moves when manually pushed into or exteriorly to a new predetermined position.

To move central basketball hoop 20*b* posteriorly, anterior-posterior adjustor bar 95 is manually pushed backwards. As seen in FIGS. 16(*a*) and 16(*b*), at the desired pre-determined distance, two groups of linearly aligned pinholes 98,99 are congruent with universal pinholes 104*a*, 104*b*. At this predetermined position metal pin 102*a*(seen at pinhole 104*a*, 104*b*) penetrates pinholes 98,99 in anterior-posterior adjustor bar 95 and universal pinholes 104*a*, 104*b*, all in a congruent manner.

Pin 104*a* is then inserted through pinholes 99, 99, 102*a*, 102*b*, and so mechanically holds common stem 19 and anterior-posterior adjustment bar 96 together. Please see also FIG. 16(*b*). Pin 104*a* pierces four-member joint 53(stem 29), as well as anterior-posterior elevated support bar 96 and anterior-posterior adjustor bar 95. A second pin 104*b* pierces a second set of single pinholes 109*a*, 109*b* through second four member joint 53 at posterior end 110, to stabilize the anterior-posterior adjustment mechanism.

Extension bars 35*a*, 35*b*, 35*c* are rigid and supports backboards 20*a*, 20*b*, 20*c* and basketball rims 21*a*, 21*b*, 21*c* respectively. Each backboard 20*a*, 20*b*, 20*c* and basketball rim 21*a*, 21*b*, 21*c* are respectively and reversibly connected to extension bars 35*a*, 35*b*, 35*c*.

Figure 29:
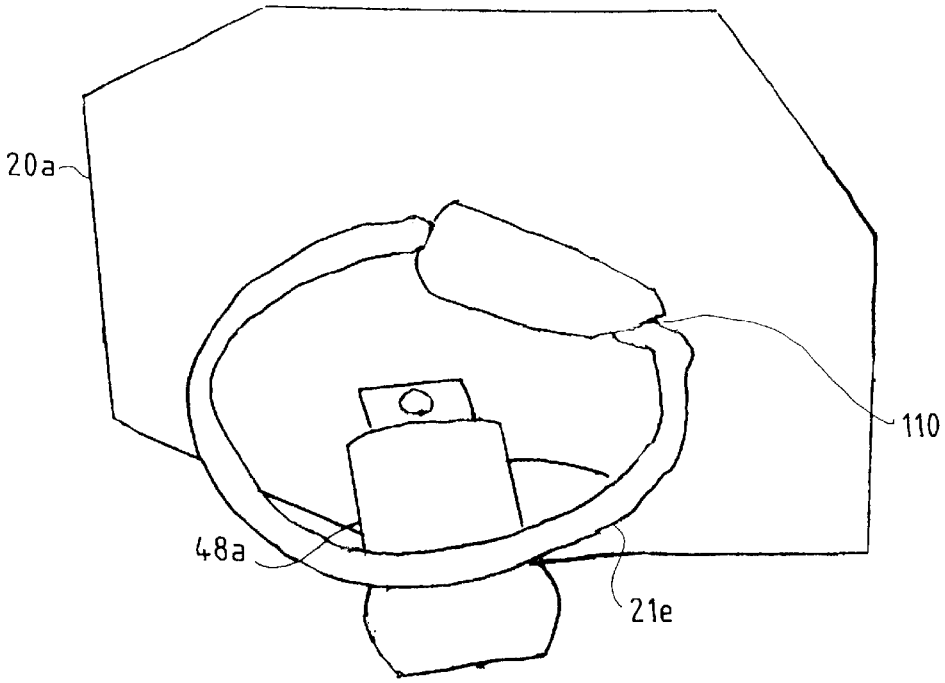
FIG. 29: Schematic isolated representation of basketball hoop pivoting in an approximately vertical manner.
Figure 29:
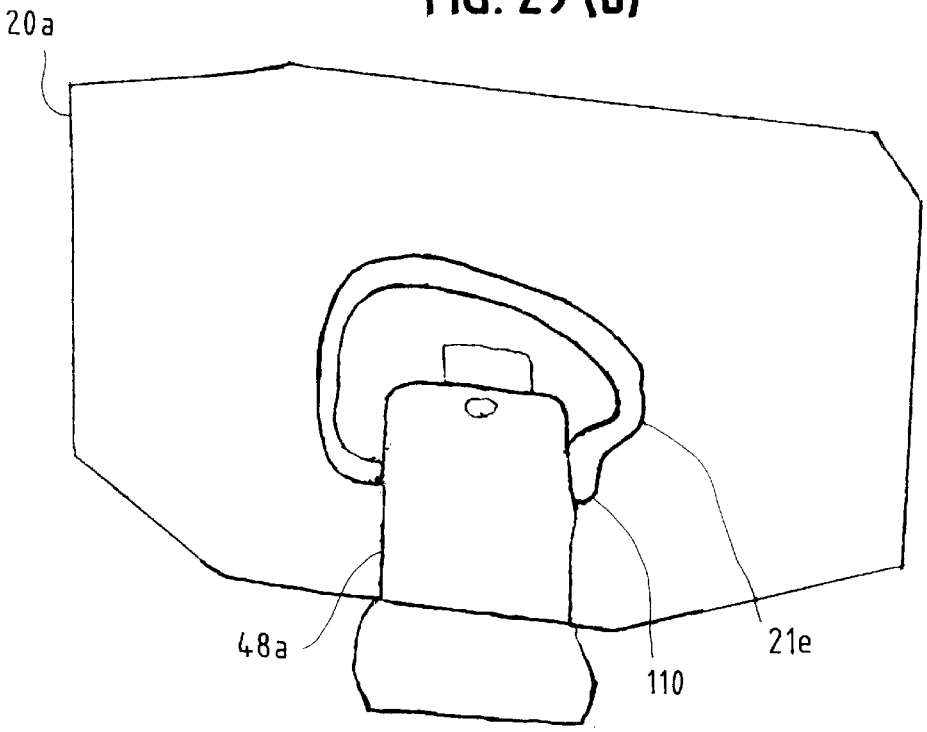

Common stem 29 at its most posterior joint 53 is rigidly attached to posterior lower basketball hoop support bar 67, as seen in FIG. 16(*b*). FIG. 11 illustrates a front view of the right side basketball hoop 21*a* prong-attachment 25*c*, 25*d*, 25*e*. As seen in FIG. 29, each basketball hoop 21*a*, 21*b*, 21*c* can be pivoted upward along hinged plastic clasp 48*a*, 48*b*, 48*c* respectively on anterior 20*ff* surface of each backboard 20*a*, 20*b*, 20*c*. Each clasp 48*a*, 48*b*, 48*c* comprises a hinged hoop which is an asset for safety and easy storage.

Each lateral side basketball hoop 21*a*, 21*c* is approximately sixty degrees from center basketball hoop 21*b* in the preferred embodiment. However, lateral basketball hoops 21*a*, 21*c* are adjustable to more or less than a sixty degree angle and still remain within the scope of my invention.

Springs for each spring attachment 21*f* in my preferred embodiment can be purchased from: Prime Line Products Company, San Bernadin, Calif. 92407. The company's "handyman springs" are recommended and are ¼ inch×one and ⅞ inches×0.035 inch in thickness. Insulation used for armpads and a back support can by purchase from Industrial Thermo Polymers Ltd. specifically, tundra energy saving pipe insulation.

Baskets with appropriate backboards, hoops, and all purpose hinged hardware included can be purchased from:

Good Stuff Corporation 47-00 33rd St.

Long Island City, N.Y. 11101

Specifically recommended is the "Looney Tunes Basketball Set" with soft basketballs.

Shepherd Hardware Products(3 Oaks, Mo, 49128, Phone 1-616-756-3830) produces "surface guard"—non-stick, self adhesive foam pads for the lower base surface of my invention.

The first exercise using the preferred embodiment is for the abdominal muscles. The person initially reclines upon a on a mat facing basketball rims 21*c*, 21*b*, 21*c*. The person next raises the upper body and places ball 100 in center basketball rim 21*b* using backboard 20*b*. The user gain reclines upon the mat while extending both arms to pull ball 100 from the bottom of basketball net 21*g*.

The user repeats this exercise with left side basketball hoop 21*c*, returns to center basketball hoop 21*b*, and repeats this exercise with right basket 21*a*.

The third exercise initially involves more agility. The user reclines on mat facing basketball hoops 21*a*, 21*b*, 21*c*, and with feet placed upon horizontal foot stand bar 22. The user raises the upper body while completing a figure eight motion with ball 100 between the legs. The user then places ball 100 into center basketball hoop 21*b* and again reclines upon the mat.

The user then extends both arms to pull ball 100 from the bottom 21*g* of basket net 21*g*. The user repeats this third exercise with left side basket 21*c*, returns to center basket 21*b*, and finally repeats this same movements to right side basketball hoop 21*a*.

My AB Challenger apparatus in the preferred embodiment or other embodiments, is light, easily collapsible, inexpensive, and easily assembled used in a small space such as an apartment. In addition to all these advantages, the exercises which can be done are truly remarkable in improving stomach muscles. Importantly, cylindrical rigid hollow upwardly protruding joints 50 do not require adhesive, nails or screws.

I claim:

1. An exercise apparatus for strengthening muscles, said exercise apparatus comprising:

(A) a base, said base comprised of rigid cylindrical components, said cylindrical components spaced along a flat rigid horizontal supporting surface and interconnected to balance said exercise apparatus, said base comprising (1) at least two parallel anterior-posterior base bars, each said parallel anterior-posterior base bar having an upper surface and a lower surface, (2) a horizontal base bar, said horizontal base bar having a first end and a second end, said horizontal base bar connected to each said parallel anterior-posterior base bars by said first end and said second end, said horizontal base bar resting upon said supporting rigid horizontal surface, (3) at least two upwardly protruding vertical basketball hoop support bars, (a) each said upwardly protruding vertical basketball hoop support bar having an upper end and a lower end, (b) each said lower end frictionally and reversibly attached in a vertical perpendicular orientation to a corresponding parallel anterior-posterior base bar along said upper surface, (B) an adjustable horizontal footstand bar, said footstand bar comprising a first end and second end, (1) said adjustable horizontal footstand bar supported at said first end and said second end by a first adjustable vertical footstand support bar and a second corresponding adjustable vertical footstand support bar, (C) a second portion of said exercise apparatus, said second portion further comprising (2) a horizontal basketball hoop support bar, said horizontal basketball hoop support bar having a first end and a second end, each said end attached to an upper end of a corresponding upwardly protruding vertical basketball rim support bar, (3) at least two devices for reversibly adjusting the vertical height of said horizontal basketball hoop support bar, above said rigid horizontal flat supporting surface, (4) a common stem, (a) said common stem being at approximately a right angle to said horizontal basketball hoop support bar, (b) said common stem protruding anteriorly across said horizontal basketball hoop support bar, said common stem connected to said horizontal basketball hoop support bar, (5) a plurality of prongs, each said prong connected to said common stem, (6) a plurality of basketball hoops, each said basketball hoop attached to a corresponding backboard, each said backboard connected to a corresponding said prong, each said basketball hoop comprising (a) a spring attachment, each said spring attachment preventing a ball from bouncing from said basketball hoop, (7) swivel members, each said swiveling member connected to a corresponding said prong, each said swivel member rotating a said basketball hoop laterally, (8) an anterior-posterior length adjustor bar, said anterior-posterior length adjustor bar connected to said common stem, said anterior-posterior length adjustor bar reversibly adjusting the anterior-posterior position of a basketball hoop, Whereby said base is attached to said upwardly protruding vertical basketball hoop support bars, said upwardly protruding basketball hoop vertical support bars supporting said horizontal basketball hoop support bar and providing adjustment of vertical height of said basketball hoops, said common stem functionally connected to swiveling members and said anterior-posterior adjustor bar, by which said basketball hoops are adjusted to a predetermined position.

2. The exercise apparatus as described in claim 1 wherein said exercise apparatus is comprised of polyvinyl chloride angled connectors, removable tee-joint connectors and polyvinyl chloride cylindrical piping, said polyvinyl chloride cylindrical piping comprising color coding for proper assembly, said joints being disconnected from said cylindrical components for portability of said exercise apparatus.

3. The exercise apparatus as described in claim 2 wherein said swiveling mechanism within said swivel member comprises an upper surface and a lower surface, said swiveling mechanism further comprising a screw and interlocking teeth, said screw penetrating said lower surface and said upper surface, said screw tightening or loosening said interlocking teeth to loosen or tighten said basketball hoops.

4. The exercise device as described in claim 3, wherein said common stem and said basketball hoop prongs are connected to a U-shaped lower basket ball hoop support bar.

5. The exercise device as described in claim 4, wherein said each spring attachment is attached at the bottom of each said corresponding basketball net.

6. The exercise device as described in claim 5 wherein each said basketball hoop vertical height adjustor bar comprises a length and an upper end and a lower end, each said basketball hoop vertical height adjustor bar further comprising (A) two generic pinhole sets in two linear alignments along the length of each said basketball hoop vertical height adjustor bar respectively and between said upper end and said lower end, (B) each said basketball hoop vertical height adjustor bar being slidably attached within one said hollow t-joint connectors at said upper end of each said upwardly protruding basketball hoop vertical support bar, (1) each said basketball hoop vertical height adjustment bar being adjusted manually by pulling vertically from within each upwardly protruding vertical basketball hoop support bar to a second predetermined vertical height, (2) said horizontal basketball support bar being raised approximately the same number of pinholes on each upwardly protruding vertical basketball hoop support bar during said manual adjustment, (a) said second predetermined vertical height being mechanically maintained by a long metal pin within each said basketball hoop vertical height adjustor bar, (b) each said long metal pin penetrating said predetermined pinholes within each corresponding basketball hoop vertical height hoop adjustor bar.

7. The exercise device as described in claim 6 wherein said horizontal basketball hoop support bar is connected to said upwardly protruding basketball hoop vertical support bars by a combination of threaded screws and said tee-joint connectors.

8. The exercise device as described in claim 7 wherein said swivel member is physically contiguous with a single swivel adjustor, (A) each said prong entering a 45 degree joint connecter, each prong contiguous with a corresponding swivel adjuster attachment, (B) each said swivel member further comprising a moveable joint and tooth members for loosing said joint member from a predetermined position.

9. The exercise device as described in claim 8 wherein each said vertical footstand support bar comprises a vertical footstand adjustor bar, (a) each said vertical footstand adjustor bar further comprising two sets of generic pinholes in vertical linear alignment, (b) each said vertical footstand adjustor bar comprising an upper end, (c) each vertical footstand adjustor bar being adjustable by the user manually pulling each said vertical footstand support bar to a new predetermined height, (d) each said vertical footstand support bar comprising an elongated rounded end pin, (i) said elongated rounded end pin being thrust through said corresponding pinholes along each corresponding vertical footstand height adjustment bar, (ii) said round ended elongated metal pins preventing slippage of said horizontal footstand support bars by at least two supporting t-joint connectors on either said end of said horizontal footstand support bar.

10. The exercise device as described in claim 9 wherein each said basketball hoop pivots upwardly along a corresponding hinged clasp on each anterior surface of each said backboard.

11. An exercise apparatus for strengthening muscles, said exercise apparatus comprising:

(A) a base, said base comprised of rigid cylindrical components, said cylindrical components spaced along a flat rigid horizontal supporting surface and interconnected to balance said exercise apparatus, said base further comprising:

(1) at least two parallel anterior-posterior base bars, said anterior-posterior base bars each comprising an upper surface and a lower surface, said parallel anterior-posterior base bars resting upon a horizontal flat rigid supporting surface, (2) a plurality of upwardly protruding hollow cylindrical joints, said joints attached at an approximate right angle to said upper surfaces, (3) a horizontal base bar, said horizontal base bar having a first end and a second end, said horizontal base bar connected to each said parallel anterior-posterior base bars by said first end and said second end respectively, said horizontal base bar resting upon said supporting flat rigid horizontal surface, (4) two upwardly protruding vertical basketball hoop support bars, (a) each said upwardly protruding vertical basketball rim support bar having an upper end and a lower end, (b) each said lower end frictionally attached in a vertical male/female orientation to each said parallel anterior/posterior base bar within a corresponding upwardly protruding cylindrical hollow joint, (i) each said upper end at an approximate right angle to said parallel anterior/posterior base bars, (ii) each said upwardly protruding vertical basketball hoop support bar comprising one vertical basketball hoop adjustor bar at each said upper end, (B) an adjustable horizontal footstand bar, said footstand bar comprising a first end and second end, (a) said adjustable horizontal footstand bar connected and supported at its first end and its second end by a first corresponding vertical footstand support bar and second corresponding vertical footstand support bar, (b) each said vertical footstand support bar being vertically adjustable by a vertical footstand adjustor bar, each said vertical footstand support bar connected to said horizontal footstand bar by a corresponding tee-joint connector, each said vertical footstand support bar connected to a corresponding said anterior-posterior bar, (C) a second portion, said second portion comprising, (2) a horizontal basketball hoop support bar, said horizontal basketball hoop support bar having a first end and a second end, each said end attached to an upper end of a corresponding upwardly protruding vertical basketball hoop support bar, (3) a common stem, said common stem comprising a four member prefabricated connector, (a) said common stem rigidly positioned at and connected to, at approximately a right angle, said horizontal basketball hoop support bar, (b) said common stem protruding anteriorly across said horizontal basketball hoop support bar at approximately said midline of said horizontal basketball hoop support bar, (4) at least three prongs, said prongs attached to said common stem through said four member prefabricated connector, said prongs protruding anteriorly to said horizontal basketball hoop support bar, each said prong connected to one corresponding extension bar, (5) at least two lateral basketball hoops and one central basketball hoop, (a) each said basketball hoop being attached to one backboard, (b) each said backboard connected to one corresponding said extension bar, (c) each said extension bar being connected to one corresponding said prong, each said prong attached to said four member prefabricated connector, (6) at least three swiveling members, each said swiveling member attached to a corresponding said prong, each said swiveling member designed to laterally rotate each said lateral basketball hoop to a second predetermined position, (7) an anterior-posterior length adjustor, said anterior-posterior length adjustor attached to said common stem, said posterior/anterior length adjustor reversibly adjusting the anterior/posterior position of said central basketball hoop, said anterior posterior length adjustor comprising a series of linearly aligned openings through which a pin is inserted, Whereby said base attaches to said vertical footstand support bars which support said horizontal footstand bar, said horizontal footstand, said horizontal footstand bar supporting a user's feet during use, said upwardly protruding vertical football hoop support bars supporting said horizontal basketball hoop support bar, said common stem attached to said horizontal basketball hoop support bar connected to said basketball hoops through said four member prefabricated connector, said prongs attached to said swiveling members, and said posterior-anterior length adjustor, so that said basketball hoops can be manually adjusted vertically, laterally, and posteriorly-anteriorly.

* * * * *